US006899448B2

(12) United States Patent
Damalas

(10) Patent No.: US 6,899,448 B2
(45) Date of Patent: May 31, 2005

(54) THEME-BASED ILLUMINATING MOBILE

(75) Inventor: Konstantinos Nicholas Damalas, St. Charles, MO (US)

(73) Assignee: Athinos Lighting, LLC, St. Louis, MO (US)

( * ) Notice: Subject to any disclaimer, the term of this patent is extended or adjusted under 35 U.S.C. 154(b) by 0 days.

(21) Appl. No.: 10/348,364

(22) Filed: Jan. 21, 2003

(65) Prior Publication Data

US 2004/0141327 A1 Jul. 22, 2004

(51) Int. Cl.[7] ..... F21S 8/06

(52) U.S. Cl. ..... 362/404; 362/234; 362/236; 362/410; 362/411

(58) Field of Search ..... 362/410, 411, 362/412, 414, 283, 284, 234, 236, 404; 40/441; 434/286, 289, 3

(56) References Cited

U.S. PATENT DOCUMENTS

| | | | | | |
|---|---|---|---|---|---|
| 2,044,551 | A | * | 6/1936 | Tompsett | 40/441 |
| 2,098,296 | A | | 11/1937 | LaGrasse | |
| 2,204,952 | A | | 6/1940 | Wittigschlager | |
| 2,226,032 | A | | 12/1940 | Wahlberg | |
| 2,878,591 | A | | 3/1959 | Harris | |
| 3,029,528 | A | | 4/1962 | Verson | |
| 3,431,410 | A | | 3/1969 | Dolan et al. | |
| 3,766,727 | A | | 10/1973 | Didik | |
| 4,097,917 | A | | 6/1978 | McCaslin | |
| 4,285,028 | A | * | 8/1981 | Sundin et al. | 362/35 |
| 4,400,162 | A | | 8/1983 | Rustemis | |
| 5,097,398 | A | | 3/1992 | Dye | |
| 5,555,658 | A | | 9/1996 | Yu | |
| 5,558,421 | A | | 9/1996 | Guastella | |
| 5,642,930 | A | | 7/1997 | Brown, Sr. | |
| 6,022,118 | A | * | 2/2000 | Wu | 362/35 |
| 2003/0035293 | A1 | * | 2/2003 | Miller et al. | 362/404 |

OTHER PUBLICATIONS

Pending U.S. Appl. No. 29/183,651 titled Theme–Based Illuminating Mobile, Damalas, filed Jun. 13, 2003.

Pending U.S. Appl. No. 29/193,711 titled Illuminating Mobile, Damalas, filed Nov. 13, 2003.

International Search Report, PCT/US03/39373, Dated Jul. 7, 2004, 4 pages.

* cited by examiner

*Primary Examiner*—Stephen Husar
*Assistant Examiner*—Anabel Ton
(74) *Attorney, Agent, or Firm*—Harness, Dickey & Pierce, P.L.C.

(57) ABSTRACT

An apparatus for illuminating and decorating a room. The apparatus includes a mounting apparatus and a theme apparatus engaged with the mounting apparatus. The mounting apparatus includes at least a first fixture adapted to receive at least a first light source. The theme apparatus includes at least one thematic component that is movable relative to the mounting apparatus. The theme apparatus also includes at least one light-altering component. The light-altering component is positioned relative to the mounting apparatus for receiving and altering light from the first light source when the first light source is engaged with the first fixture such that the altered light illuminates at least a portion of the room with thematic light.

30 Claims, 17 Drawing Sheets

THEME-BASED ILLUMINATING MOBILE

FIELD OF THE INVENTION

The present invention relates generally to lighting fixtures and more particularly to illuminating mobiles.

BACKGROUND OF THE INVENTION

When decorating a room, the selection of appropriate lights is usually based on several criteria such as shape, color, size, brightness, size of the room, types of activities for which the room will be used, among others. Ideally, the lights selected provide sufficient illumination for the activities that will be performed in the room.

Another consideration when selecting the lighting system is user preference. For example, the room being decorated may be a child's bedroom. If so, it is often the case that the child's bedroom will be equipped with a "nightlight" to ease the child's fear of the dark and/or to make it easier for a parent to respond to the child's nighttime requests or pleas.

The child's interests may also be taken under consideration as many parents choose to decorate their child's bedroom in a manner consistent with the child's interests. For example, the parents of a child having an interest in dinosaurs may decorate the child's bedroom with wallpaper, curtains, beddings, posters, pictures, among other things, that contain dinosaur images, thus providing the room with a dinosaur-related theme or motif.

As almost any parent can attest, however, children's interests are often fleeting. A child's fervent interests in one subject may quickly fade and be replaced with an interest in another wholly unrelated subject. Obviously then, it can be quite difficult for parents to keep up with their child's current interests yet alone redecorate their child's bedroom each time the child's interests change. Indeed, for those parents who decorate their child's room with relatively permanent features, such as wallpaper, it may be virtually impossible for the parents to keep their child's room up-to-date with his or her interests.

Accordingly, a need remains in the art for devices and methods that are capable of illuminating a room with night light and with regular light and that are capable of providing the room with a thematic atmosphere. The devices and methods should allow a user to readily switch between a plurality of themes in a tool-less fashion (i.e., without the need for tools). Ideally, the devices should be capable of being readily retrofit to existing ceiling junction boxes with little to no additional tooling being needed and without the need for additional ceiling structural reinforcement.

SUMMARY OF THE INVENTION

In order to solve these and other needs in the art, the inventor hereof has succeeded in designing a theme-based illuminating mobile for illuminating and decorating a room. In one exemplary embodiment, the theme-based illuminating mobile includes a mounting apparatus and a theme apparatus engaged with the mounting apparatus. The mounting apparatus includes at least a first fixture adapted to receive at least a first light source. The theme apparatus includes at least one thematic component that is movable relative to the mounting apparatus. The theme apparatus also includes at least one light-altering component. The light-altering component is positioned relative to the mounting apparatus for receiving and altering light from the first light source when the first light source is engaged with the first fixture such that the altered light illuminates at least a portion of the room with thematic light.

Further areas of applicability of the present invention will become apparent from the detailed description provided hereinafter. It should be understood that the detailed description and specific examples, while indicating at least one exemplary embodiment of the invention, are intended for purposes of illustration only and are not intended to limit the scope of the invention.

BRIEF DESCRIPTION OF THE DRAWINGS

The present invention will be more fully understood from the detailed description and the accompanying drawings, wherein.

DETAILED DESCRIPTION OF THE EXEMPLARY EMBODIMENTS

Figure 1:
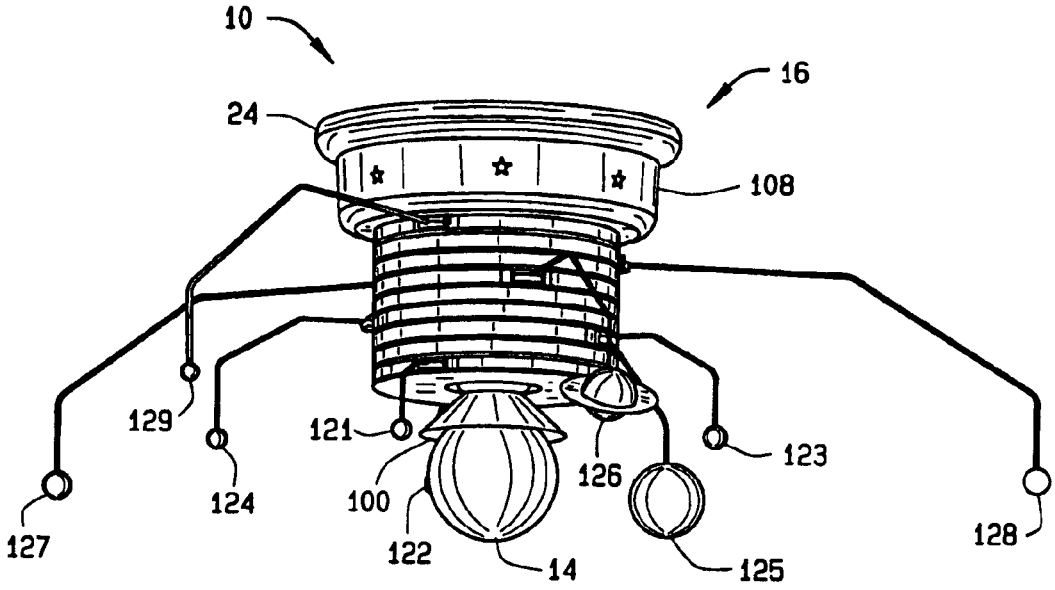
FIG. 1 is a perspective view of an exemplary theme-based illuminating mobile while provided with an exemplary celestial theme apparatus according to one embodiment of the present invention.
Figure 2:
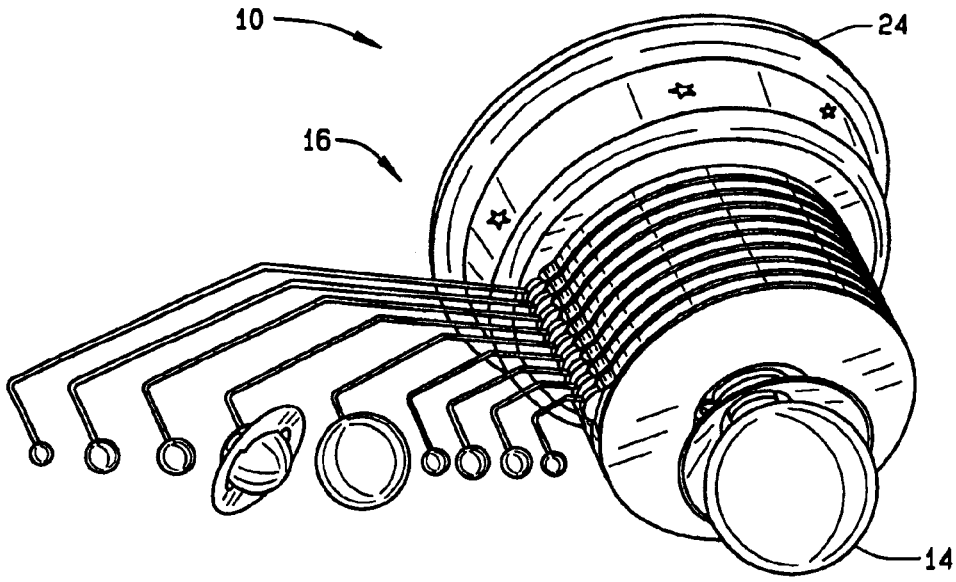
FIG. 2 is another perspective view of the theme-based illuminating mobile shown in FIG. 1.

The following description of the exemplary embodiments is merely exemplary in nature and is in no way intended to limit the invention, its application, or uses.

Certain terminology will be used in the following description for the purpose of reference only, and thus are not intended to be limiting. For example, the terms proximal, proximally, or proximal direction or proximally is the direction towards the ceiling or other surface supporting the theme-based illuminating mobile, whereas distal, distally, or distal direction is the direction away from the ceiling or other support surface for the theme-based illuminating mobile. Further, terms such as "upper", "lower", "above", and "below" refer to directions in the drawings to which reference is made. Terms such as "front", "back", "rear", and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

Referring to FIGS. 1 through 5, a theme-based illuminating mobile according to one embodiment of the present invention is generally indicated by reference numeral 10. Generally, the theme-based illuminating mobile 10 may include a first light source 12 (not seen in FIGS. 1 through 3 but shown in FIGS. 4 and 5) and a second light source 14. The light sources 12 and 14 allow the theme-based illuminating mobile 10 to provide night light and regular light. The light sources 12 and 14 may also be used to further enhance the thematic atmosphere provided by the theme-based illuminating mobile 10. As described in detail below, light from either or both of the lighting sources 12 and/or 14 may be altered (e.g., refracted, reflected, diffracted, dispersed, etc.) by a light-altering component such that the altered light illuminates at least a portion (e.g., ceiling, wall, floor, etc.) of the room in which the mobile 10 is located with thematic light (e.g., silhouettes, light patterns, effects, etc.) in accordance with or thematically related to the present theme of the mobile 10.

The theme-based illuminating mobile 10 may also include a plurality of readily interchangeable theme apparatus that are each engageable with a mounting apparatus 18. Any of a wide range of themes may be used for the various theme apparatus. The exemplary embodiments include a celestial or outer space theme apparatus 16, a carousel theme apparatus 300 shown in FIGS. 16 through 18, a disco theme apparatus 400 shown in FIGS. 19 and 20, an aerospace theme apparatus 500 shown in FIGS. 21 through 23. Each of the respective theme apparatus allows the theme-based illuminating mobile 10 to provide a different thematic atmosphere or environment. Because the theme apparatus are readily interchangeable (i.e., readily removed and provided on the mounting apparatus 18), the theme-based illuminating mobile 10 allows a user to change a room's atmosphere in a relatively simple manner. Obviously, the atmosphere of the room may be further enhanced by appropriately decorating the room with other items (e.g., curtains, beddings, etc.) consistent or associated with the theme apparatus being used.

Figure 21:
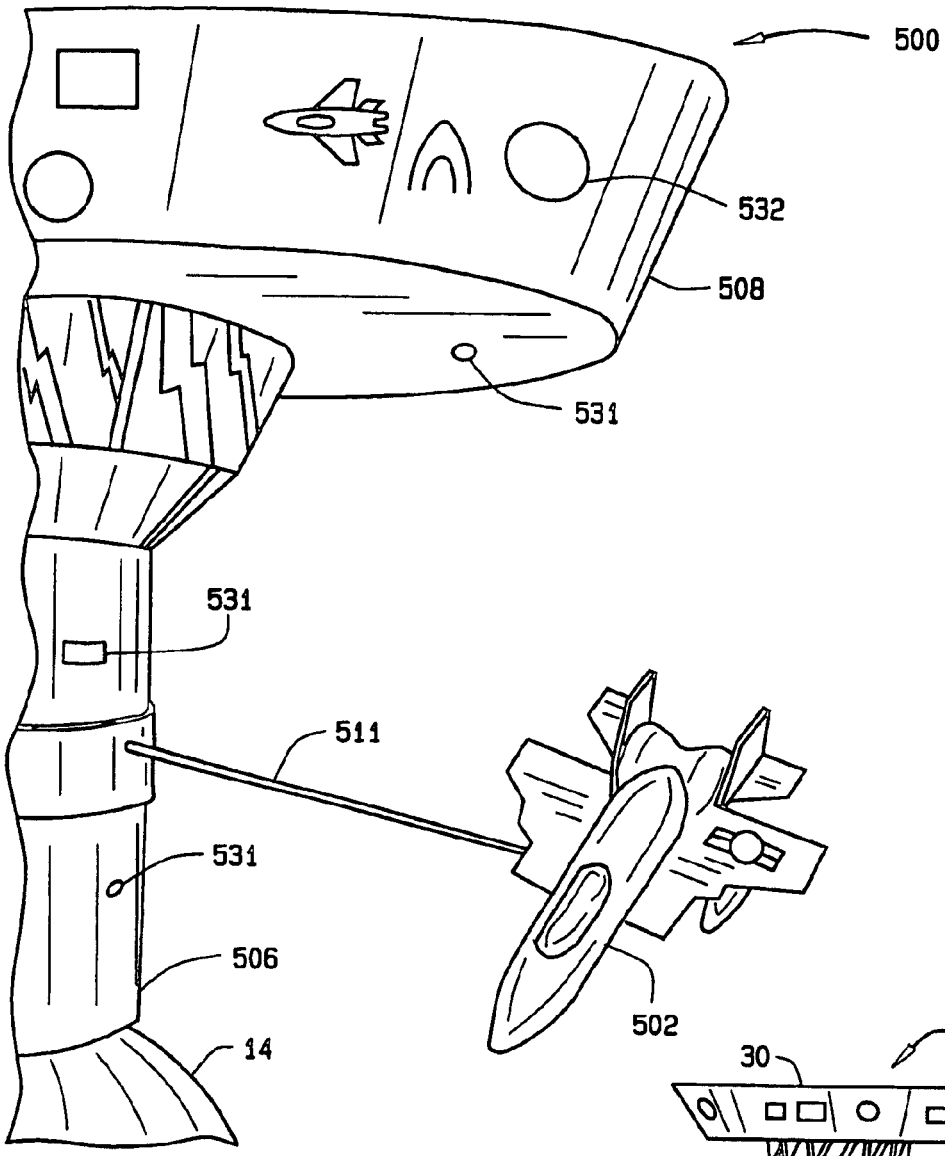
FIG. 21 is a partial perspective view of the theme-based illuminating mobile while provided with an exemplary aerospace theme apparatus.

Each theme apparatus includes at least one mobile element or thematic component that is movable relative to the theme-based illuminating mobile 10. In the exemplary embodiments, the mobile elements comprise a planetary body 102 (FIG. 14), a carousel horse and pole 302 (FIG. 16), a mirrored element 404 (FIG. 19), a fighter jet 502 (FIG. 21).

Each theme apparatus may also include at least one light-altering component (e.g., filter, lens, mirror, aperture, colored film, etc.) that alters (e.g., refracts, reflects, diffracts, disperses, focuses, filters, blocks, etc.) light from either or both of the lighting devices 12 and/or 14 to produce thematic light patterns or effects. For example, the light-altering component may alter light from the first light source 12 such that the altered light illuminates a celestial pattern on the ceiling to which the mobile 10 may be attached. To further enhance the thematic atmosphere, each theme apparatus may also be thematically decorated with any of a wide range of decorative features such as thematic decals, stickers, artistic designs, colors, graphics, among others.

In the illustrated embodiment, the theme-based illuminating mobile 10 includes a mounting apparatus 18. It should be noted that the order in which the various components comprising the mounting apparatus 18 are assembled may vary and that such components need not be assembled in the order in which they are described herein.

Figure 7:
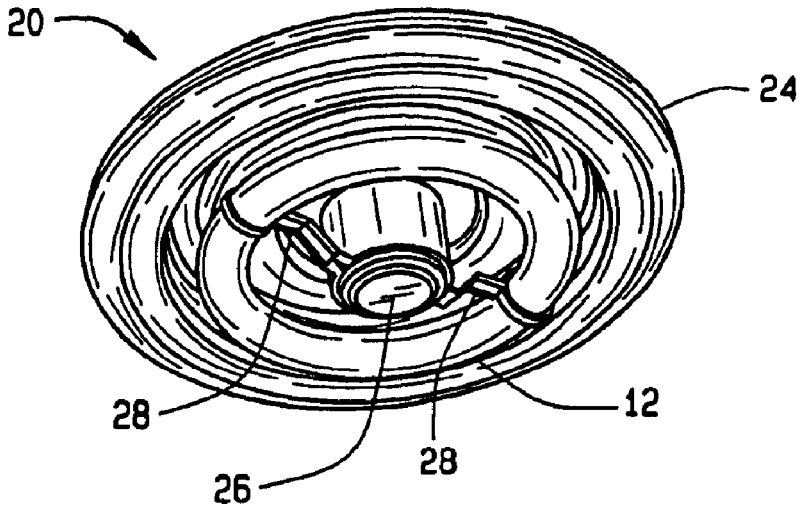
FIG. 7 is a perspective view of the base of the mounting apparatus shown in FIG. 6.
Figure 8:
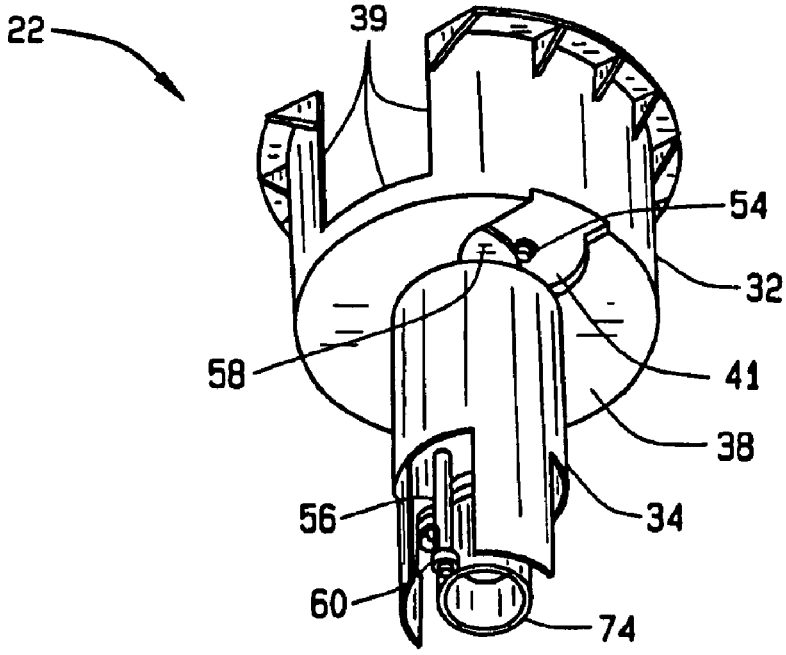
FIG. 8 is a perspective view of an exemplary housing of the theme-based illuminating mobile shown in FIG. 1.

The mounting apparatus 18 includes a base 20 (FIG. 7) and a housing 22 (FIG. 8). The base 20 comprises a plate 24, a ballast 26 disposed at about the center of the plate 24, the first light source 12 and connection brackets 28 that electrically connect the first light source 12 to the ballast 26. The ballast 26 is used to start and control the flow of power to the first lighting device 12. The plate 24 and/or the ballast 26 of the mounting apparatus 18 are provided with one or more holes that allow one or more electrical wires therethrough, which may then be used to connect the second lighting device 14 to a ceiling junction box.

During operation, the first lighting device 12 can be used as a nightlight and/or to display or illuminate a thematic light pattern or effect (e.g., silhouettes, images, etc.) in the room in which the theme-based illuminating mobile 10 is being used. Any of a wide range of light sources may be used for the first lighting device 12. When selecting the particular light source for the first lighting device 12, safety standards developed by Underwriters Laboratories Inc.® (UL®) and/or the American National Standards Institute, Incorporated (ANSI®) may be considered. In addition, because the first lighting device 12 is encapsulated or enclosed within the nightlight shade 30, the heat generated by the various light sources under consideration for the first lighting device 12 is a consideration. Preferably, the first lighting device 12 generates illumination that is substantially uniform with respect to a bulb cover or nightlight shade 30 (shown in FIG. 11 and described in greater detail later) disposed substantially around the first lighting device 12. By way of example only, the first lighting device 12 in the illustrated embodiment comprises a ring-type fluorescent bulb.

The base 20 allows the theme-based illuminating mobile 10 to be installed into (e.g., mounted and electrically connected to) a ceiling junction box in a manner substantially similar to the process used to install many currently available off-the-shelf ceiling lighting fixtures and ceiling fans to standard ceiling junction boxes. Accordingly, the theme-based illuminating mobile 10 in the illustrated embodiment is compatible with and can be readily retrofit to existing standard ceiling junction boxes.

After the theme-based illuminating mobile 10 has been installed into a ceiling junction box, the main source of power for the theme-based illuminating mobile 10 can be controlled with the wall-mounted light switch connected to the ceiling junction box. Because the process of installing a light fixture or ceiling fan into a ceiling junction box is well-known in the art, the process of installing the theme-based illuminating mobile 10 into a ceiling junction box is not described in further detail herein.

In an alternative embodiment, the theme-based illuminating mobile may instead be configured for placement upon a horizontal support surface (e.g., floor, desktop, tabletop, etc.), with the theme-based illuminating mobile being provided with an electrical cord sized for connection with a standard wall outlet. In yet another embodiment, the theme-based illuminating mobile may be configured for mounting to a wall or other substantially vertical surface.

Referring now to FIG. 8, the housing 22 includes a first housing member 32 engageable with the base plate 24 and a second housing member 34 engageable with the first housing member 32. It should be noted, however, that in other embodiments the first and second housing members 32 and 34 need not comprise separate components but instead may comprise a single component.

Figure 9:
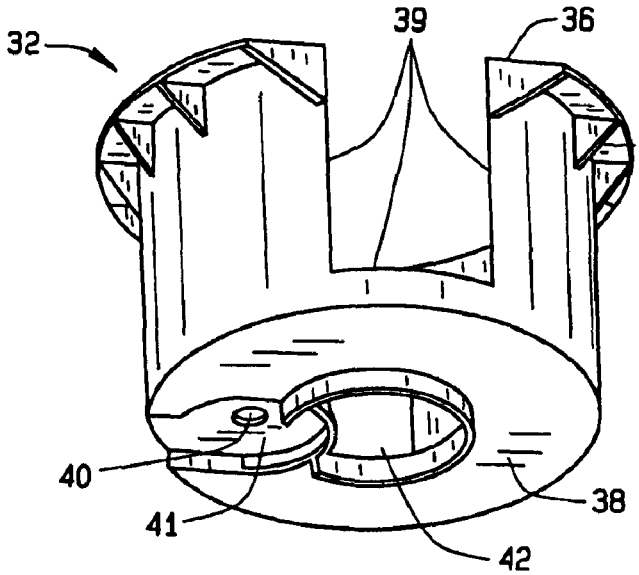
FIG. 9 is a perspective view of the first housing member of the housing shown in FIG. 8.

As shown in FIG. 9, the first housing member 32 has a substantially open proximal end 36 and a distal end 38. The substantially open proximal end 36 is sized to fit between the ballast 26 and the first lighting device 12. To accommodate for the connection brackets 28, the first housing member 32 includes cutaway or removed side portions 39.

Figure 10:
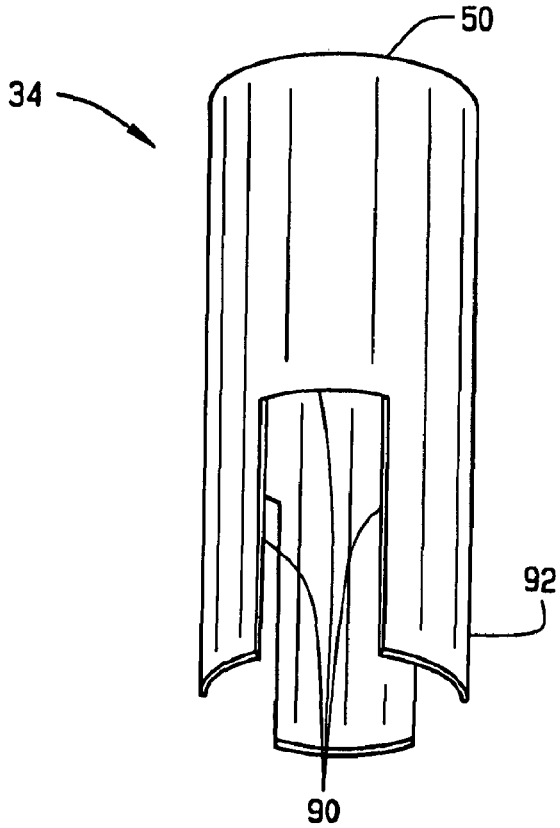
FIG. 10 is a perspective view of the second housing member of the housing shown in FIG. 8.

The distal end 38 of the first housing member 32 defines a first opening 40 disposed within a recessed portion 41. The distal end 38 further defines a second opening 42 sized to receive a proximal end 50 of the second housing member 34, which is shown in FIG. 10.

Figure 12:
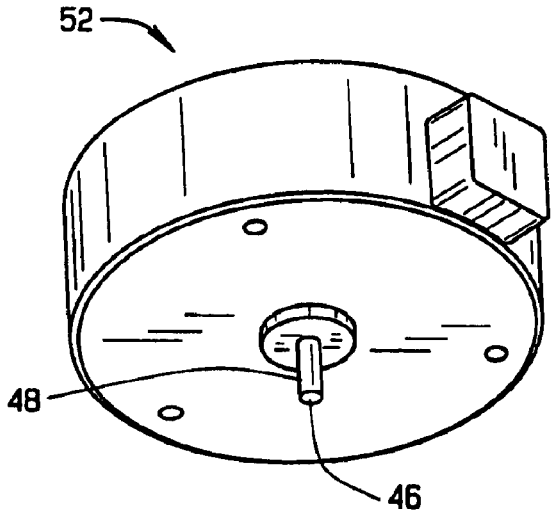
FIG. 12 is a perspective view of an exemplary motor of the theme-based illuminating mobile shown in FIG. 1.

The first opening 40 is sized to receive a distal end 46 of a motor shaft 48 (FIG. 12). The recessed portion 41 is sized to receive at least a portion of a drive shaft gear 58 therein (FIG. 8).

The proximal end 50 of the second housing member 34 may be fastened or secured within the second opening 42 of the first housing member 32 by any one of a wide range of suitable fastening systems and devices. When selecting the appropriate fastening system or device (e.g., interference or friction fit, screws, rivets, detents, snap-fit, etc.), however, UL® safety standards should be considered. In addition to the UL® standards, other considerations may also be taken into account including but not limited to weight, simplicity, and costs, among others. By way of example only, the second housing member 34 may be fastened to the first housing member 32 by way of a snap-fit.

Figure 5:
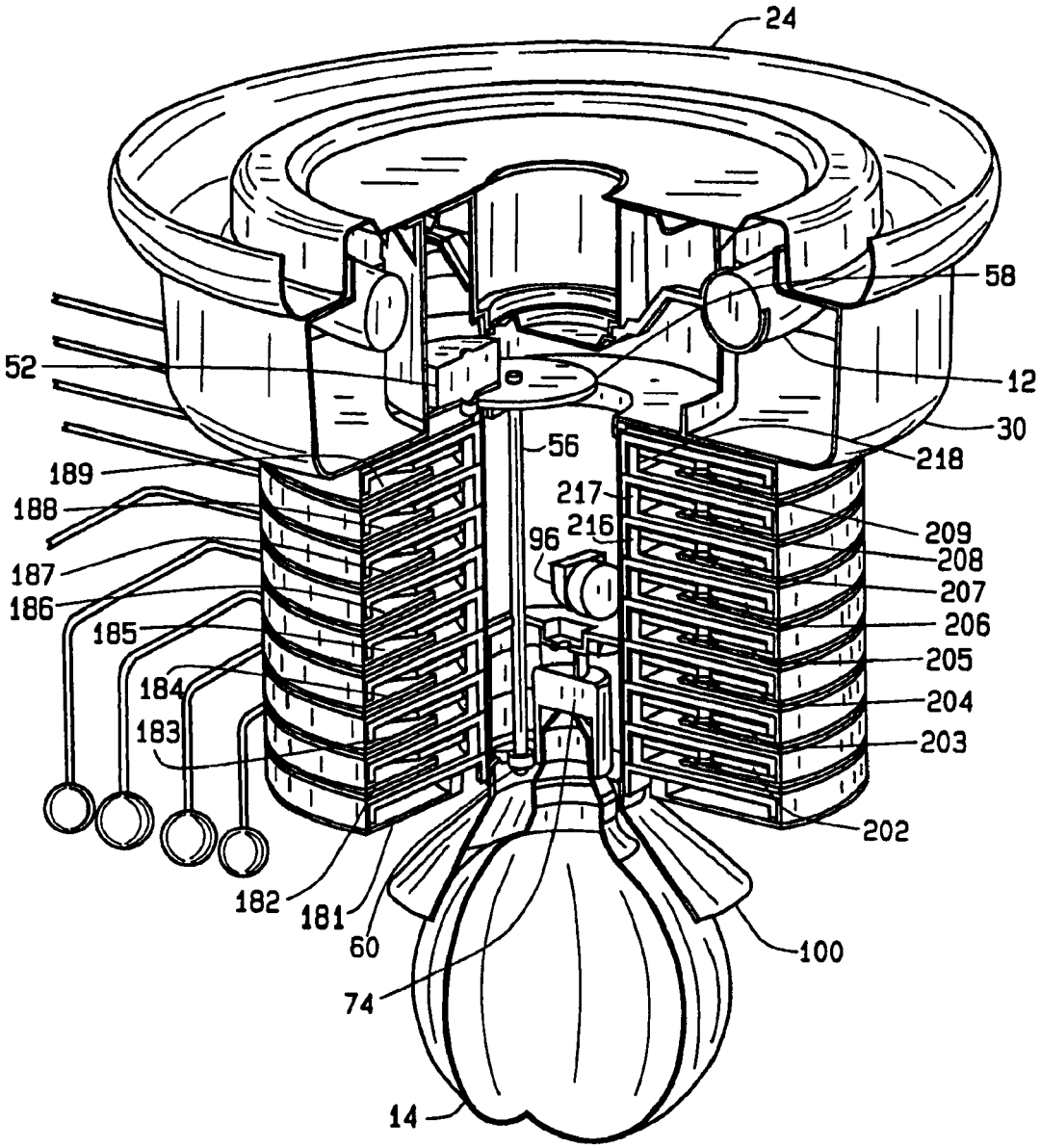
FIG. 5 is a cutaway partial perspective view of the theme-based illuminating mobile shown in FIG. 1 with portions removed for clarity.
Figure 6:
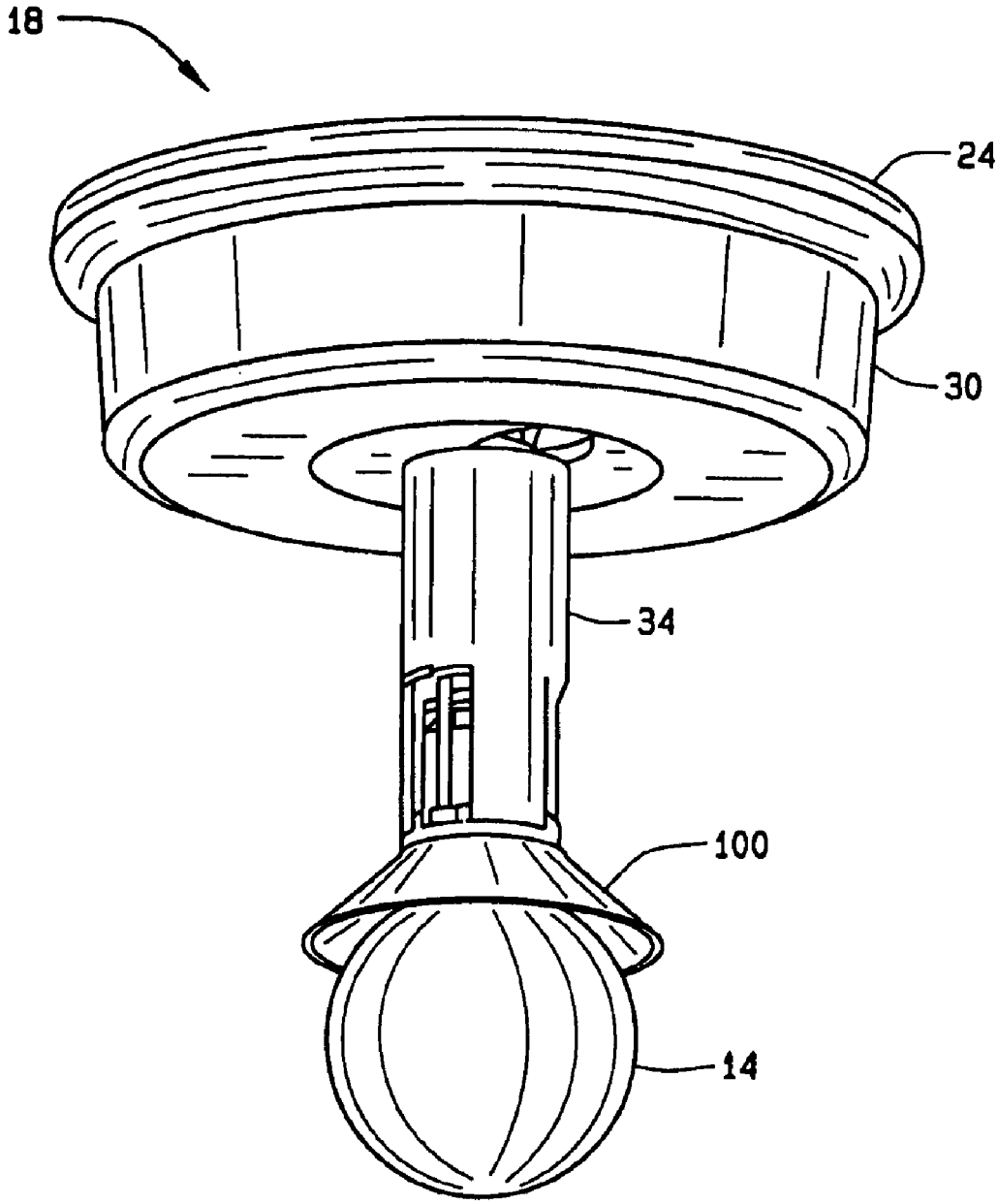
FIG. 6 is a perspective view of an exemplary mounting apparatus of the theme-based illuminating mobile shown in FIG. 1.

The mounting apparatus 18 also includes an actuator for moving at least one of the components comprising the theme apparatus. As shown in FIG. 5, the actuator comprises a motor 52 having a shaft 48. A motor pinion gear 54 is mounted to (e.g., press fit onto) the distal end 46 of the motor shaft 48. The actuator further includes a drive shaft 56, a drive shaft gear 58 mounted on the proximal end of the drive shaft 56, and a drive shaft pinion gear 60 mounted on the distal end of the drive shaft 56.

When the mounting apparatus 18 is assembled, the motor pinion gear 54 is positioned adjacent the drive shaft gear 58 such that rotation of the motor pinion gear 54 rotates the drive shaft gear 58. Accordingly, the actuator operates as follows: the motor 52 rotates the motor shaft 48; the rotating motor shaft 48 rotates the motor pinion gear 54; the rotating motor pinion gear 54 rotates the drive shaft gear 58; the rotating drive shaft gear 58 mounted to the proximal end of the drive shaft 56 rotates the drive shaft 56; the rotating drive shaft 56 rotates the drive shaft pinion gear 60 mounted to the distal end of the drive shaft 56.

In the illustrated embodiment, the actuator is disposed substantially within the housing 22. More specifically, the motor 52 is disposed within the first housing member 32 at a position to allow the distal end 46 of the motor shaft 48 to extend though the first opening 40 (FIG. 9) defined by the distal end 38 of the first housing member 32. The drive shaft 56 is disposed substantially within the second housing member 34 such that the proximal end of the drive shaft 56 is disposed adjacent the first opening 40 of the first housing member 32. Accordingly, the drive shaft gear 58 mounted to the proximal end of the drive shaft 56 is at least partially disposed within the recessed portion 41 of the first housing member 32 and is engaged with the motor pinion gear 54 mounted to the distal end 46 of the motor shaft 48.

Any of a wide range of suitable motors, drive shafts, and gears may be used for the actuator. The component selection for the actuator may be based at least in part on UL® safety standards. In addition to the UL® standards, other considerations may also be taken into account such as noise, durability, and heat generation. Preferably, the motor 52 has a 100% duty cycle and is operable with standard house current (e.g., 120-volt alternating current). By way of example, the motor pinion gear 54, drive shaft gear 58, and drive shaft pinion gear 60 may each be fabricated from Delrin®, a synthetic resinous plastic material from E.I. Du Pont® De Nemours and Company Corporation of Wilmington, Del.

Figure 11:
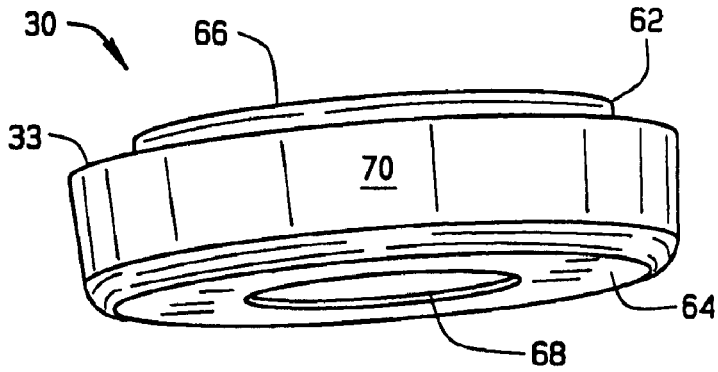
FIG. 11 is a perspective view of an exemplary nightlight shade of the theme-based illuminating mobile shown in FIG. 1.

Referring now to FIG. 11, the theme-based illuminating mobile 10 further includes a bulb cover or nightlight shade 30 having a proximal end 62 and a distal end 64. The proximal end 62 defines an opening 66 sized to allow the nightlight shade 30 to be disposed around the first lighting device 12. The proximal end 62 also defines threads or grooves that are sized to engage corresponding threads or grooves defined by the base plate 24, thus allowing the nightlight shade 30 to be threadably engaged with the base plate 24.

The distal end 64 of the nightlight shade 30 defines an opening 68 and a shoulder 33 disposed around the opening 68. The distal and proximal end openings 66 and 68 are each sized and sufficiently aligned with one another to allow the nightlight shade 30 to be slid onto and off of the second housing member 34. Accordingly, the nightlight shade 30 can be engaged with and disengaged from the base plate 24 without the removal of the housing 22 from the base 20.

To enhance the thematic atmosphere produced by the theme-based illuminating mobile 10, the nightlight shade 30 is configured to focus the light from the first lighting device 12 outward through the sidewall 70 of the nightlight shade 30. To accomplish this feat, the nightlight shade 30 has incorporated therein Fresnel technology. That is, the nightlight shade 30 comprises a Fresnel-type curved lens that focuses light from the first lighting device 12 laterally outward.

Any of a wide range of materials may be used for the nightlight shade (glass, plastic, etc.). By way of example only, the nightlight shade 30 in one embodiment comprises a transparent or translucent plastic material.

The theme-based illuminating mobile 10 in the illustrated embodiment includes the first illumination device 12 and the second illumination device 14. In other embodiments, however, the mobile 10 may include a single illumination apparatus capable of providing night lighting, regular lighting, and thematic lighting (e.g., silhouettes, images, patterns, effects, etc.). In such embodiments, the single lighting device may be dimmable and/or be capable of generating different types of light (i.e., light having different attributes, such as color, intensity, hue, saturation, brightness, etc.) tailored to the specific use for which light will be used.

When selecting the light source for the second lighting device 14, UL® and ANSI® safety standards may be considered. In addition, user preferences, the size of the room in which the theme-based illuminating mobile 10 is going to be used, and the activities that will be performed in the room may also be considered. Moreover, the theme apparatus that will be used with the theme-based illumination mobile 10 may also be considered when selecting the light source for the second lighting device 14. For example, it is generally preferred, but not required, that the second lighting device 14 comprise a globe-shaped light bulb for representing the Sun in the celestial theme apparatus 16 (FIG. 1). By way of example only, the second lighting device 14 may comprise an incandescent globe light bulb.

Figure 13:
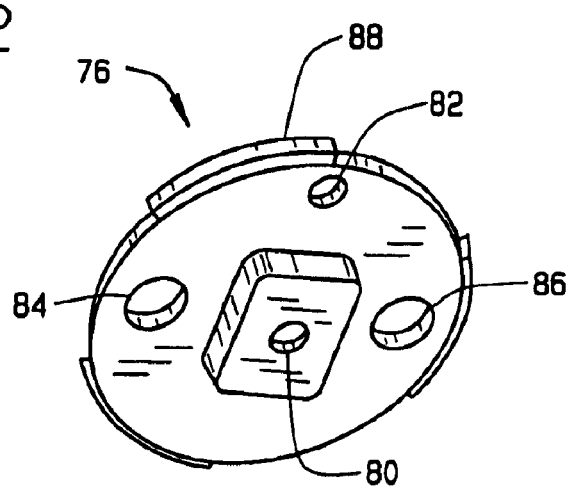
FIG. 13 is a perspective view of an exemplary socket cap of the theme-based illuminating mobile shown in FIG. 1.

As shown, the second lighting device 14 is disposed substantially distally and centrally with respect to the theme-based illuminating mobile 10. The second lighting device 14 is mounted to the theme-based illuminating mobile 10 by way of a socket apparatus that includes a socket 74 and a socket fixture or cap 76 (FIG. 13). More specifically, the second lighting device 14 is threadably mounted to the socket 74, which in turn is mounted to the socket cap 76.

The socket cap 76 defines a plurality of openings 80, 82, 84 and 86. In the illustrated embodiment, the first opening 80 is sized to receive at least a portion of a mechanical fastener which is used to mount the socket 74 to the socket cap 76. The second opening 82 is sized to receive at least a portion of the drive shaft 56 therethrough. The third and fourth openings 84 and 86 are sized to receive chain switch nuts, the purpose of which are described in detail below.

The socket cap 76 may also define an opening sized to allow one or more electrical wires therethrough, which are used to electrically connect the socket 74 to the ceiling junction box. To make the connection between the socket 74 and the ceiling junction box, the electrical wires may extend through an opening in the base plate 24, through the first and second housing members 32 and 34, and through an opening in the socket cap 76.

The socket cap 76 may further include at least one ear or extended portion 88 sized to engage at least one cutaway or removed side portions 90 (FIG. 10) disposed at a distal portion 92 of the second housing member 34. By engaging the ears 88 of the socket cap 76 with the cut-away side portions 90 of the second housing member 34, the socket cap 76 becomes engaged with the second housing member 34.

The theme-based illuminating mobile 10 can have more than one operating mode. For example, the theme-based illuminating mobile 10 has a theme display mode in which the first lighting device 12 and the motor 52 are both operating while the second lighting device 14 is off. The theme-based illuminating mobile 10 also has an off mode in which both lighting devices 12 and 14 and the motor 52 are off. The theme-based illuminating mobile 10 further includes a nightlight mode wherein the first lighting device 12 is on but the motor 52 and the second lighting device 14 are both off. Yet another operating mode includes a mode in which the motor 52 and both lighting devices 12 and 14 are on. Still yet another operating mode includes a regular lighting mode during which the second lighting device 14 is on but the motor 52 and the first lighting device 12 are both off. It should be noted that the amount of light needed for regular and night light conditions will likely depend at least in part on user preference, the size of the room in which the theme-based illuminating mobile 10 will be used, and the types of activities for which the room will be used.

To allow a user to select from amongst the various operating modes, the theme-based illuminating mobile 10 includes at least one switch. Although any number of (i.e. one or more) suitable switches may be used, the exemplary embodiment of the theme-based illuminating mobile 10 comprises three switches, namely, a first switch for controlling the flow of electrical power to the theme-based apparatus 10, a second switch for controlling the operational status of the motor 52, and a third switch 96 for toggling between the first and second lighting devices 12 and 14.

The first switch may comprise the wall-mounted light switch associated with the ceiling junction box in which the theme-based illuminating mobile 10 is installed. Accordingly, the first switch may be used to control the flow of electricity to the theme-based illuminating mobile 10.

The second switch may be selected from any of a wide range of suitable switches such as toggle switches, rotary switches, push button switches, tact switches, rocker switches, pull-chain switches, slide switches, timer switches, voice-activated switches, touch-sensitive switches, keylock, among others. By way of example only, the second switch may comprise a single pole single throw (SPST) pull-chain switch.

The third switch 96 allows a user to toggle between the first and second lighting devices 12 and 14, thus allowing the user to choose to have either the first or the second lighting device 12 or 14 operating. Alternatively, the third switch 96 may also have another setting in which both lighting devices are off, and thus provide the theme-based illuminating mobile 10 with still yet another operating mode (i.e., motor on, both lighting devices off). The third switch may have yet another setting wherein both lighting devices are on, and thus provide the theme-based illuminating mobile 10 with two additional operating modes (i.e., motor on with both lighting devices on, motor off with both lighting devices on).

Any of a wide range of suitable switches may be used for the third switch 96 including, but not limited to, toggle switches, rotary switches, push button switches, tact switches, rocker switches, pull-chain switches, slide switches, timer switches, voice-activated switches, touch-sensitive switches, keylock, among others. By way of example only, the third switch 96 may comprise a single pole double throw (SPDT) pull-chain switch.

In other embodiments of the theme-based illuminating mobile, a single switch may be used for controlling the main power, for controlling the on/off status of the motor 52, and for toggling between the lighting devices 12 and 14. In such embodiments, the user would thus be able to select from amongst the various operating modes of the theme-based illuminating mobile 10 by accessing the single switch.

To allow a user to access the second and third switches 96, chain switch nuts and pull chains extending therefrom are used. The chain switch nuts are engaged with the respective second and third switches 96. The chain switch nuts extend partially through the third and fourth holes 84 and 86 of the socket cap 76, shown in FIG. 13. In addition, a chain guide 100 is preferably disposed substantially around the second lighting device 14 to protect the second lighting device 14 from the dangling pull chains.

The various theme apparatus will now be described in detail. It should be noted, however, that any of a wide range of themes may be used for a corresponding one of the plurality of theme apparatus. Accordingly, theme apparatus having themes different than what is shown and described herein may be used without departing from the spirit and scope of the invention.

Each theme apparatus includes at least one mobile thematic element that is movable relative to the theme-based illuminating mobile 10. For example, in the illustrated embodiments described in detail below, the thematic components of the various theme apparatus include a planetary body 102 (FIG. 14), a carousel horse and pole 302 (FIG. 16), a mirrored element 402 (FIG. 19), a fighter jet 502 (FIG. 21), among others. The thematic components are operatively associated with the actuator such that the thematic components move (e.g., rotates about the second lighting device 14, rotates about a central longitudinal axis 104, moves proximally and distally) when the actuator is operating.

Each theme apparatus includes at least one light-altering component (e.g., filter, lens mirror, aperture, colored film, etc.) that alters (e.g., refracts, reflects, diffracts, disperses, focuses, filters, blocks, etc.) light from either or both of the lighting devices 12 and/or 14 such that the altered light illuminates at least a portion of the room in which the mobile 10 is being used with thematic light. To further enhance the thematic atmosphere, each theme apparatus may also be thematically decorated with any of a wide range of decorative features such as thematic decals, stickers, designs, colors, mirrors, graphics, among others.

FIGS. 1 through 5 illustrate the theme-based illuminating mobile 10 while provided with a celestial or outer space theme apparatus 16. The celestial theme apparatus 16 includes a nightlight lens or celestial pattern filter 108 disposed circumferentially around the nightlight shade 30. The celestial pattern filter 108 is sized to be received within external grooves defined by the sidewall 70. Accordingly, light emitted by the first lighting device 12 passes through the nightlight shade 30 and then through the celestial pattern filter 108. The celestial pattern filter 108 is configured such that the light filtered thereby displays a celestial pattern. For example, the filtered light may display a silhouette or image of a celestial body, such as a star, comet, planet, moon, black hole, rocket, space ship, satellite, among others.

To increase the effectiveness of the celestial pattern filter 108, the celestial theme apparatus 16 may further comprise a light-blocking or opaque member sized to substantially cover the shoulder 33 of the nightlight shade 30. The light-blocking member at least partially prevents light from passing distally through the shoulder 33 of the nightlight shade 30 when the light-blocking member is positioned adjacent the shoulder 33.

Figure 14:
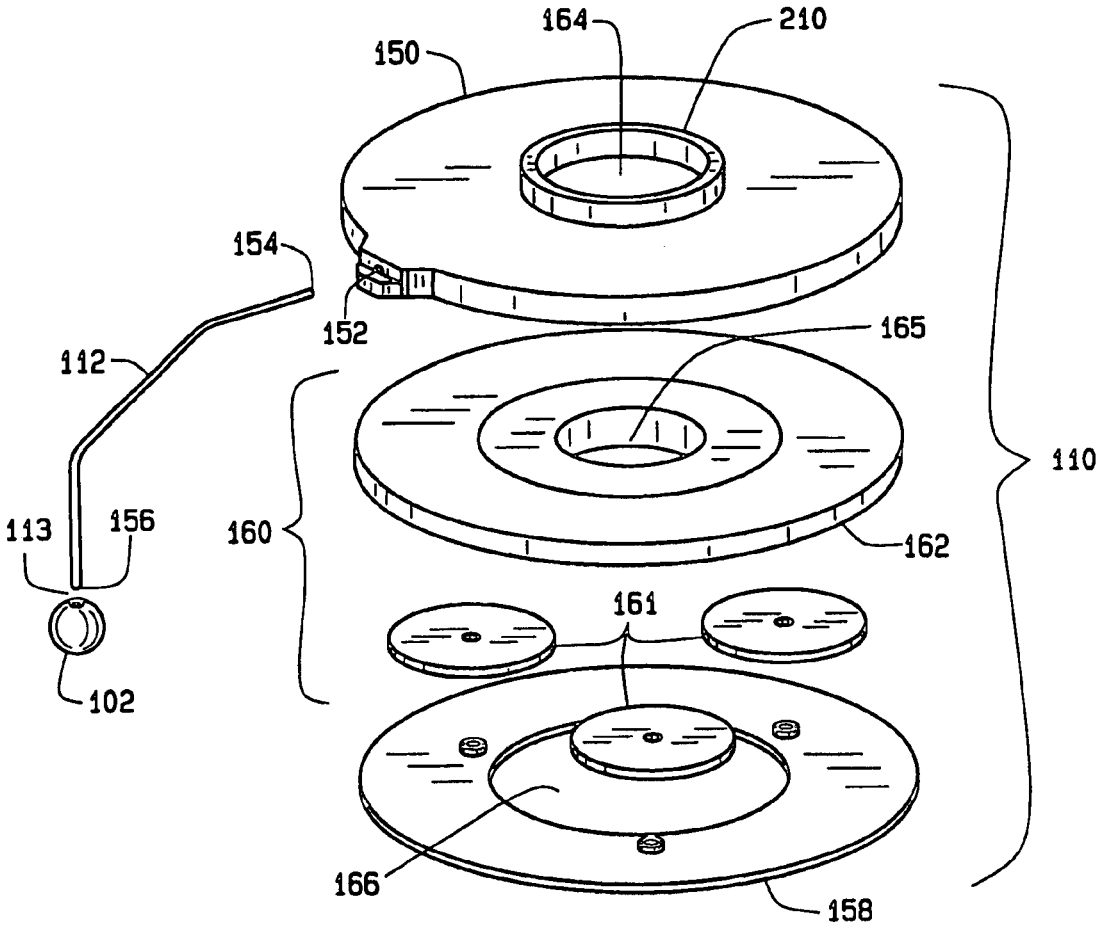
FIG. 14 is an exploded perspective view of an exemplary arm base or carrier of the celestial theme apparatus shown in FIG. 1.
Figure 15:
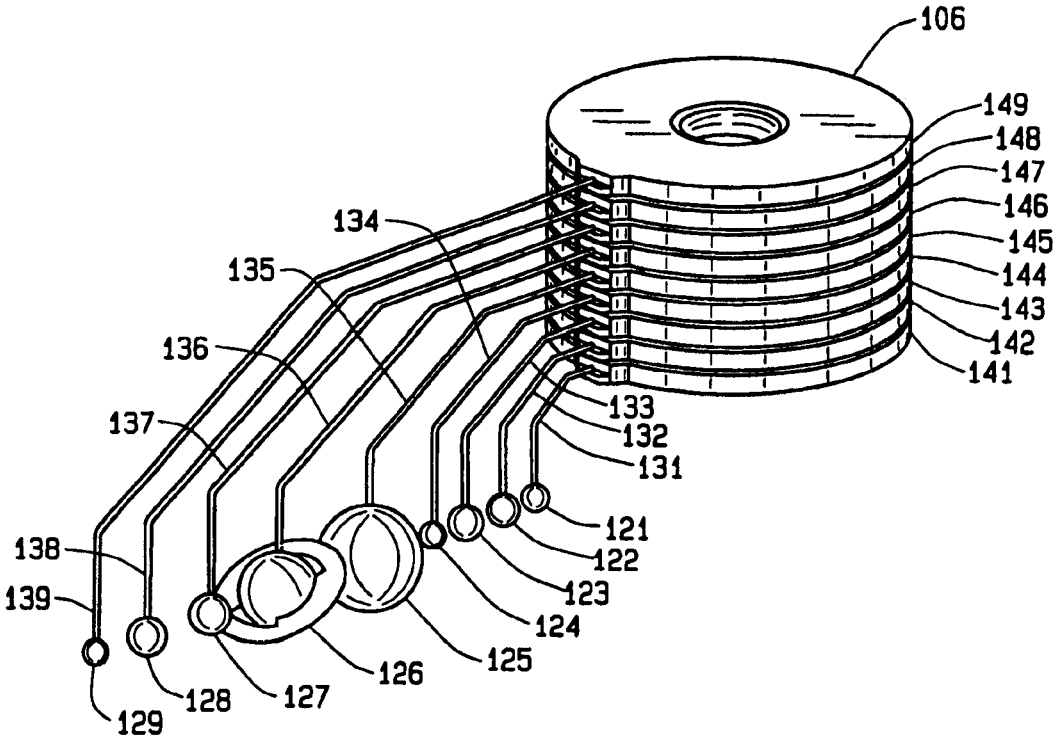
FIG. 15 is a perspective view of an exemplary carrier stack of the celestial theme apparatus shown in FIG. 1.

Referring now to FIGS. 14 and 15, the celestial theme apparatus 16 includes a hub or celestial body carrier stack 106 (FIG. 15). The celestial body carrier stack 106 includes at least one arm base or carrier 110 (FIG. 14) and at least one celestial body 102 (e.g., planet, star, comet, planet, moon, black hole, rocket, space ship, satellite, among others) attached to the carrier 110 by way of a mounting arm 112. The mounting arm 112 preferably comprises a flexible wire-like member, although such is not required. The celestial body 102 may be attached to the mounting arm 112 by way of a breakaway connection 113 that allows the celestial body 102 to be readily engaged with and disengaged from the mounting arm 112.

In the illustrated embodiment, the thematic components of the celestial theme apparatus 16 comprise nine substantially spherical objects 121, 122, 123, 124, 125, 126, 127, 128, and 129 representative of the nine planets (i.e., Mercury, Venus, Earth, Mars, Jupiter, Saturn, Uranus, Neptune, Pluto) of the Solar System. In other embodiments, however, the celestial theme apparatus may comprise more or less than nine celestial bodies, some or all of which that are not planetary bodies.

Because they are intended to represent the nine planets of the Solar System, the thematic components 121 through 129 vary in size. However, the relative sizes are not to scale because the planetary sizes in our Solar System vary tremendously from the smallest (i.e., Pluto) to the largest (i.e., the Sun).

In addition, the movable thematic components 121 through 129 may be provided with details consistent with the planet represented thereby. For example, the planet 123 representing Earth may be provided with oceans and continents by way of color, etching, etc. Or for example, the planet 126 representing Saturn may be provided with rings. As yet another example, the planet 125 representing Jupiter may be provided with a red spot.

The movable thematic components 121 through 129 may be made from any of a wide range of materials and by any of a wide range of manufacturing processes. Preferably, however, the planets 121 through 129 are made by injection molding a plastic material.

To enhance the celestial atmosphere produced by the theme-based illuminating mobile 10, the movable thematic objects 121 through 129 may "glow in the dark" through the use of luminescent pigments or powder (e.g., phosphorescent, photoluminescent). For example, a glow paint may be applied to the external surfaces of one or more of the planets 121 through 129. Or for example, glow pellets may be used during an injection molding process.

Figure 3:
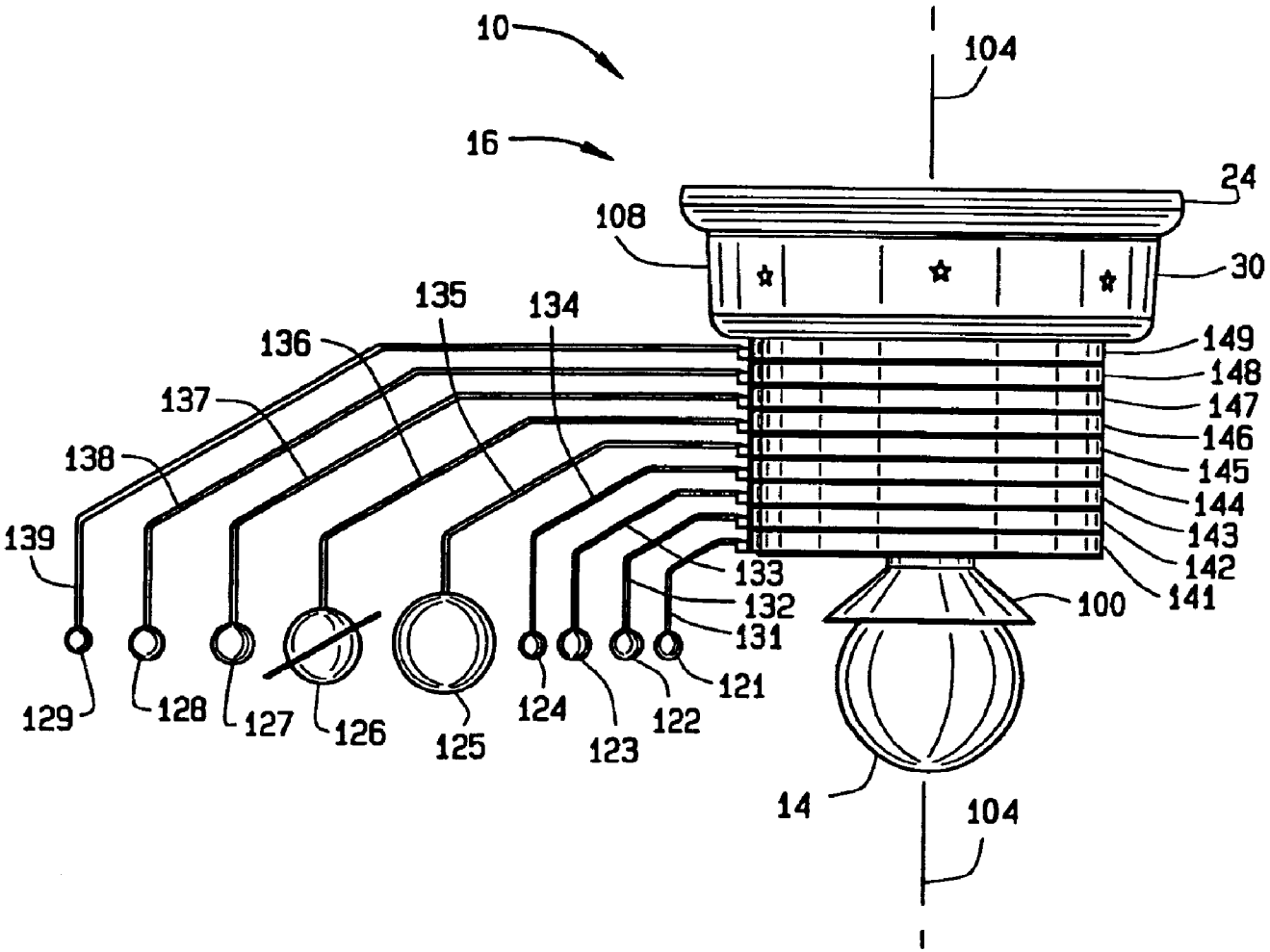
FIG. 3 is a side view of the theme-based illuminating mobile shown in FIG. 1.

As shown in FIGS. 3 and 15, each planetary body 121 through 129 is attached to the celestial body carrier stack 106 by way of a corresponding mounting arm 131, 132, 133, 134, 135, 136, 137, 138, and 139, respectively. One or more of the planets 121 through 129 are provided with appropriate axial tilts from perpendicular. For example, the planet 123 representing Earth has an axial tilt of about 23.45 degrees.

The mounting arms 131 through 139 are sized to position the planets 121 through 129 relative to the second lighting device 14 (which is intended to represent the Sun) in the following order: Mercury, Venus, Earth, Mars, Jupiter, Saturn, Uranus, Neptune, and Pluto. The distances separating adjacent planets from each other differ for each of the various sets of planets. For example, in the illustrated embodiment, the distance separating the Venus planet 122 from the Earth planet 123 is less than the distance separating the Saturn planet 126 from the Uranus planet 127. Because the distances separating the planets from the Sun in our Solar System vary tremendously, the relative distances separating the planets 121 through 129 are not to scale.

To enhance the realism, educational value, and thematic atmosphere, among other things, each of the planets 121 through 129 preferably rotates counterclockwise about (i.e., orbits) the second lighting device 14 (representing the Sun in the celestial theme apparatus 16) at a speed different than and/or independent from that of the other planets. In addition, the planets 121 through 129 orbit the second lighting device 14 at speeds that are approximately and relatively proportional to the actual orbital speeds of the planets about the Sun. Indeed, the planets of the celestial theme apparatus may each be configured to orbit about the second lighting device in a time that is substantially equal to the actual time required by the planet represented thereby to complete one full orbit about the Sun in our Solar System. For example, in such an embodiment, the planet representing the Earth in the celestial theme apparatus would thus require one Earth year to complete a single orbit about the second lighting device assuming, of course, that the actuator is operating continuously during that year.

To allow the planets 121 through 129 to orbit the second lighting device 14 at different speeds, the celestial body carrier stack 106 comprises nine celestial body carriers 141, 142, 143, 144, 145, 146, 147, 148, and 149, as shown in FIGS. 3 and 15. Each celestial body carrier 141 through 149 is operatively associated with its corresponding planet 121 through 129 via a corresponding one of the mounting arms 131 through 139.

The nine celestial body carriers 141 through 149 are essentially identical to the exemplary celestial body carrier 110 shown in FIG. 14 and which will now be described in detail. The exemplary celestial body carrier 110 includes a top portion 150 and a bottom portion 158 engaged to the top portion 150. The top portion 150 defines an opening 152 sized to receive an end 154 of the mounting arm 112.

The celestial body carrier 110 also includes a planetary gear system 160 disposed or sandwiched between the top and bottom portions 150 and 158. The planetary gear system 160 preferably includes three planetary gears 161, although a greater or lesser number may be used. The planetary gears 161 are each engageable with the drive shaft pinion gear 60 of the actuator, although not necessarily at the same time. The planetary gears 161 may comprise any of a wide range of materials (metals, plastics, etc.) including, but not limited to, Delrin®, a synthetic resinous plastic material from E.I. Du Pont® De Nemours and Company Corporation of Wilmington, Del.

The planetary gears 161 are mounted to the celestial body carrier bottom 158 such that the planetary gears 161 are disposed or sandwiched between the bottom 158 and a fixed ring gear 162. When the celestial body carrier 110 is assembled, the planetary gears 161 are engaged with the fixed ring gear 162. See FIG. 4 (dashed circle 163, showing engagement between a planetary gear 202 and inside portion of a fixed ring gear 192).

In operation, the celestial body 102 is caused to rotate about the central longitudinal axis 104 (FIG. 3) of the celestial theme apparatus 16 as follows: the motor 52 rotates the motor pinion gear 54; the rotating motor pinion gear 54 rotates the drive shaft gear 58; the rotating drive shaft gear 58 rotates the drive shaft 56; the rotating drive shaft 56 rotates the drive shaft pinion gear 60; the rotating drive shaft pinion gear 60 rotates the planetary gears 161; the rotating planetary gears 161 engage the fixed ring gear 162 which remains stationary and thus causes rotation of the carrier bottom portion 158; the rotating bottom portion 158 rotates the carrier top portion 150, which ultimately rotates the mounting arm 112 and celestial body 102.

To allow the celestial body carrier stack 106 to be engaged with the mounting apparatus 18 (FIGS. 1 through 5), the celestial body carrier 110 defines an opening that is sized to allow the celestial body carrier stack 106 to be slid onto and off of the second housing member 34. More specifically, the carrier top 150, the fixed ring gear 162, and the carrier bottom 158 define openings 164, 165, and 166, respectively, that are sized to receive the second housing member 34 therein. After the celestial body carrier 110 is assembled, the openings 164, 165, and 166 are substantially aligned with one another and the three planetary gears 161 are sufficiently spaced apart such that the celestial body carrier 110 may be slid onto and off of the second housing member 34. Accordingly, after the second lighting device 14 and chain guide 100 have been removed, the celestial body carrier 110 may be engaged with or disengaged from the mounting apparatus 18 without having to remove the second housing member 34 of the mounting apparatus 18.

Figure 4:
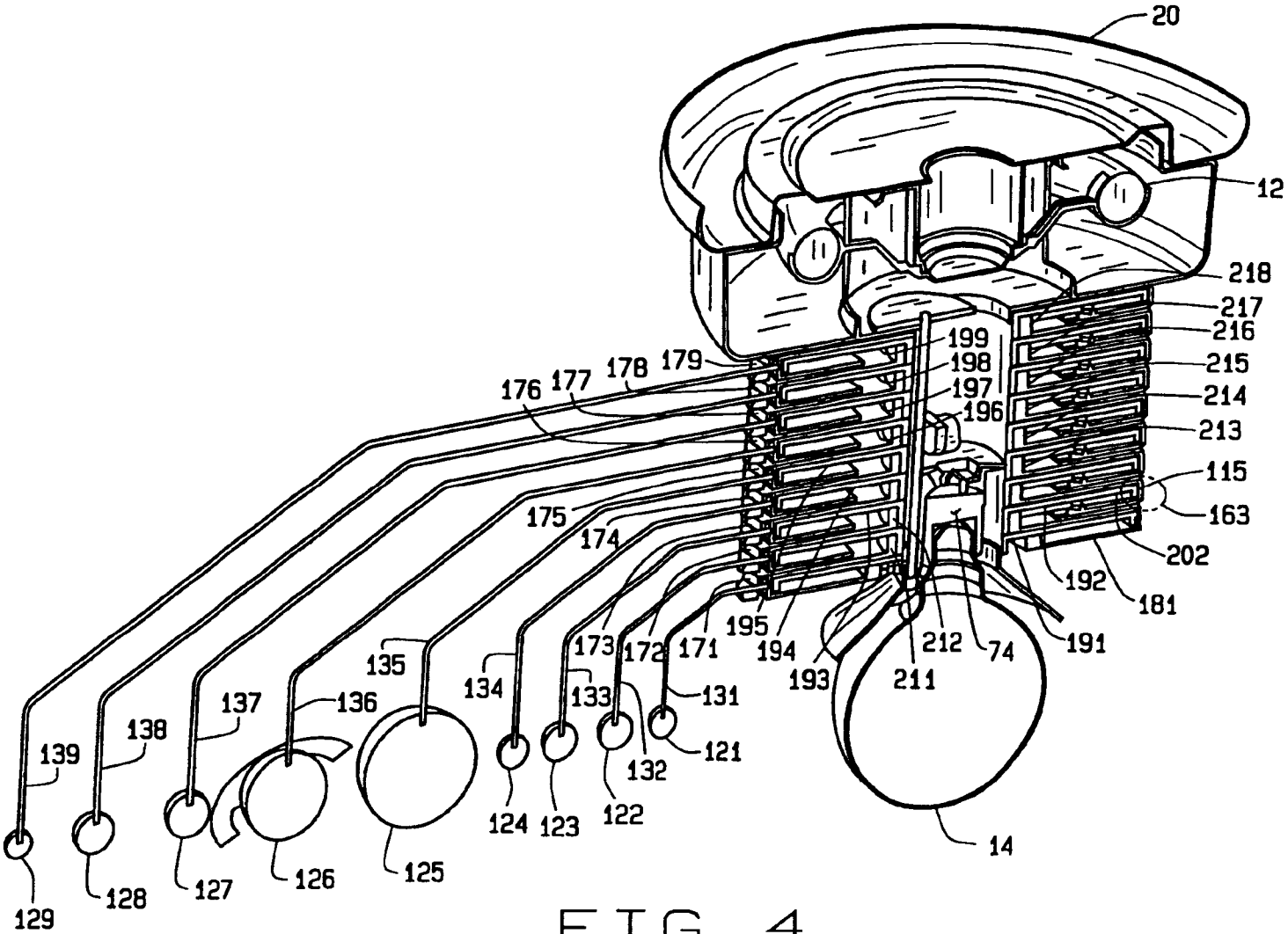
FIG. 4 is a cross-sectional perspective view of the theme-based illuminating mobile taken through the plane of FIG. 3.

Referring now to FIGS. 3, 4, and 5, the nine carriers 141 through 149 are each substantially similar to the exemplary carrier 110 shown in FIG. 14. Accordingly, the carriers 141 through 149 each comprise a carrier top 171, 172, 173, 174, 175, 176, 177, 178, and 179, respectively, to which is attached a corresponding mounting arm 131 through 139. Each carrier 141 through 149 further includes a carrier bottom 181, 182, 183, 184, 185, 186, 187, 188, and 189, respectively, that is engaged to the corresponding carrier top 171 through 179. A fixed or stationary ring gear 191, 192, 193, 194, 195, 196, 197, 198, and 199 is disposed or sandwiched between the respective carrier tops 171 through 179 and bottoms 181 through 189. With the exception of the Mercury carrier 141 which is engaged directly with the drive shaft pinion gear 60, a plurality of planetary gears 202, 203, 204, 205, 206, 207, 208, and 209 are mounted to the respective carrier bottoms 182 through 189. As before with the exemplary celestial body carrier 110, the planetary gears 202 through 209 are engaged with the corresponding fixed ring gears 192 through 199. In FIG. 4, the dashed circle 163 shows engagement between the planetary gear 202 and the fixed ring gear 192.

The fixed ring gears 191 through 199 for the carriers 141 through 149, respectively, are engaged with one another. For example, in the illustrated embodiment, the fixed rings gears 141 through 149 comprise a single unit. That is, the fixed ring gear 191 for the Mercury carrier 141 is attached to the fixed ring gear 192 of the Venus carrier 142, which in turn is attached to the fixed ring gear 193 of the Earth carrier 143, and so on. Accordingly, the entirety of the celestial body carrier stack 106 is removed from or placed onto the second housing member 34 as a single unit.

Referring back to the illustrated embodiment, the celestial body carrier tops 171 through 178 associated with the planets 121 through 128 (i.e., the eight planets with the exception of Pluto 129) are each provided with a proximally extending portion 211, 212, 213, 214, 215, 216, 217, and 218, respectively. See FIGS. 4 and 14 (showing a proximally extending portion 210 for the exemplary celestial body carrier 110). The proximally extending portions 211 through 218 are each provided with external teeth for engaging the planetary gears 202 through 209 of the celestial body carriers 142 through 149 disposed proximally thereto.

In the illustrated embodiment, the Mercury carrier top and bottom 171 and 181 are rotated by the drive shaft pinion gear 60. The planetary gears 202 through 209 for the eight remaining celestial body carriers 142 through 149 are each engageable and thus rotatable by the corresponding carrier disposed immediately proximal thereto in the celestial body carrier stack 106. For example, the Mercury carrier 141 engages and rotates the Venus planetary gears 202, the Venus carrier 142 engages and rotates the Earth planetary gears 203, and so on. Accordingly, the actuator rotates each of the nine planets 121 through 129 about the central longitudinal axis 104 (FIG. 3). By using gears having different attributes (e.g., size, gear ratio, number of teeth, etc.) for the planetary gears, the actuator may rotate one or more of the planets 121 through 129 about the longitudinal axis 104 at a speed different than that of the other planets.

In addition, a locking mechanism (e.g., locking pins and detents, bayonets, etc.) may also be provided that allows the celestial body carrier stack 106 to be releasably secured to the mounting apparatus 18. Any of a wide range of locking systems, devices, and methods may be used to releasably secure the celestial body carrier stack 106 to the mounting apparatus 18. Preferably, the locking mechanism selected is readily accessible to the user and allows the celestial body carrier stack 106 to be readily engaged with and disengaged from the mounting apparatus 18.

The theme-based illuminating mobile 10 may be used as follows to provide a room with an outer space or celestial atmosphere. First, the theme-based illuminating mobile 10 must be fitted or provided with the celestial theme apparatus 16, if it has not already been so provided. To do so, the main power is shut off by way of the first switch, and the second lighting device 14 and chain guide 100 are removed. If the theme-based illuminating mobile 10 has an existing theme apparatus, such as the carousel theme apparatus 300, the carousel theme apparatus 300 must first be removed. To do so, the locking mechanism is first disengaged to release the hub 306 of the carousel theme apparatus 300 from the mounting apparatus 18. Once released, the hub 306 may be slid off of the second housing member 34. After the carousel hub 306 has been removed, the nightlight lens or cover portion 308 disposed around the nightlight shade 30 is removed.

The nightlight shade 30 is threadably disengaged from the base plate 24. The light-blocking member is placed within the nightlight shade 30. The nightlight shade 30 is threaded onto the base plate 24. Next, the celestial pattern filter 108 is placed with the external grooves defined by the outside surface 70 of the nightlight shade 30.

The celestial body carrier stack 106 is then slid onto the second housing member 34 until the locking mechanism engages. The chain guide 100 and second lighting device 14 are reassembled onto the second housing member 34.

Now that the theme-based illuminating mobile 10 has been provided with the celestial theme apparatus 16, the theme display mode may now be selected by accessing the first switch to activate the main power, the second switch to activate the motor 52, and the third switch 96 to select the first lighting device 12. If the theme display mode is selected, the first lighting device 12 generates light that is filtered by the celestial pattern filter 108. In addition, the nine celestial body carriers 141 through 149 and the planets 121 through 129 attached thereto are caused to rotate about the central longitudinal axis 104 as follows: the motor 52 rotates the motor shaft 48; the rotating motor shaft 48 rotates the motor pinion gear 54; the rotating motor pinion gear 54 rotates the drive shaft gear 58; the rotating drive shaft gear 58 rotates the drive shaft 56; the rotating drive shaft 56 rotates the drive shaft pinion gear 60; and the rotating drive shaft pinion gear 60 rotates the Mercury carrier top and bottom 171 and 181.

The Mercury proximally extending portion 211 as it rotates causes the rotation of the Venus planetary gears 202, which in turn engage the Venus fixed ring gear 192. The Venus fixed ring gear 192, however, remains stationary and thus causes the rotation of the Venus carrier bottom 182. The rotating carrier bottom 182 rotates the Venus carrier top 172, which in turn rotates the support arm 132 and Venus 122 mounted thereto. The manner in which the remaining celestial body carrier tops 173 through 179 and their respective planets Earth 123, Mars 124, Jupiter 125, Saturn 126, Uranus 127, Neptune 128, and Pluto 129 are rotated is substantially similar to the manner just described for Venus, and is thus not described in further detail herein.

Figure 17:
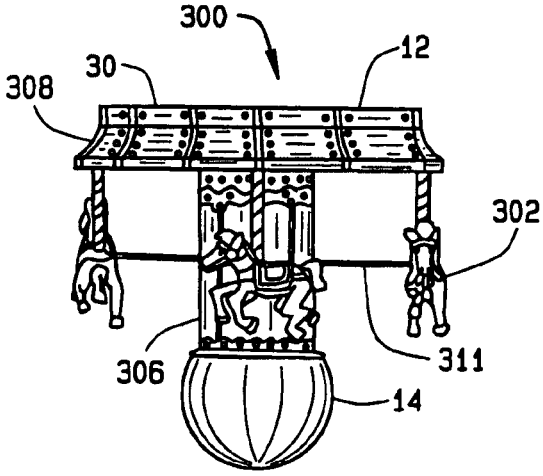
FIG. 17 is a side view of the theme-based illuminating mobile and carousel theme apparatus shown in FIG. 16.
Figure 18:
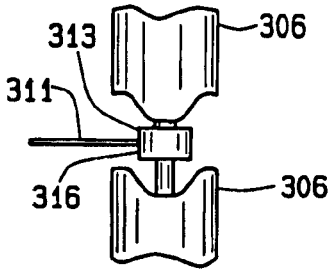
FIG. 18 is an exploded partial side view of a hub of the carousel theme apparatus shown in FIG. 17 and illustrating a mounting arm engaged with a portion of an actuator.
Figure 16:
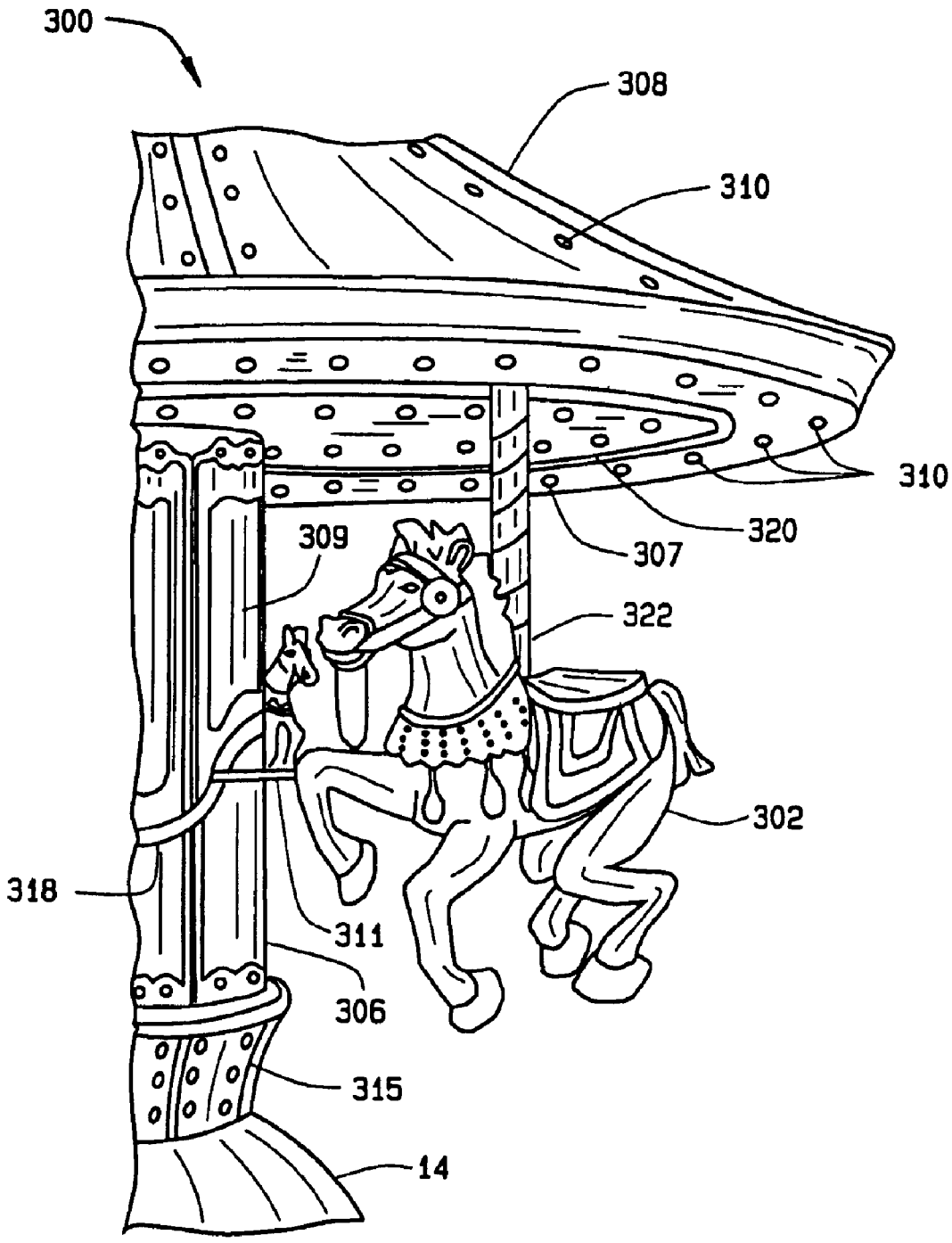
FIG. 16 is a partial perspective view of the theme-based illuminating mobile while provided with an exemplary carousel theme apparatus.

FIGS. 16 through 18 illustrate the carousel theme apparatus 300 in which the movable thematic components 302 comprise carousel horse and pole assemblies and the light-altering components comprises colored film 307 and a nightlight lens or cover 308 disposed around the nightlight shade 30. As shown, the cover 308 is decorated in a manner consistent with a carousel. In addition, the cover 308 is also provided with a plurality of holes 310, which allow light from the lighting devices 12 and 14 to pass therethrough. To change the color of the light passing through the holes 310, colored film 307 is disposed adjacent the holes 310.

The carousel theme apparatus 300 further includes a hub 306 that is decorated in a manner consistent with a carousel. For example, the hub 306 may be provided with one or more mirrors 309 and one or more holes 315, which allow light from the first and/or second lighting device 12, 14 to pass therethrough. As before with the holes 310 in the cover 308, colored film may be disposed adjacent the holes 315 to change the color of the light passing through the holes 315.

The hub 306 is sized to be received over the second housing member 34. After being received over the second housing member 34, a locking mechanism may be used to releasably secure the hub 306 of the carousel theme apparatus 300.

The carousel horse and pole assemblies 302 rotate about the hub 306 when the actuator is operating. As shown, each carousel horse and pole assembly 302 is attached by way of a breakaway connection to a mounting arm 311, which preferably comprises a flexible wire or wire-like member. The mounting arm 311 has another end 313 attached to a gear 316 that is rotatable by the actuator. See FIG. 18.

Referring back to FIG. 16, the hub 306 defines a track that allows the carousel horse and pole assemblies 302 to translate or move up-and-down (i.e., proximally and distally) while rotating about the hub 306. The mounting arms 311 are positioned within and guided by the track 318 as the mounting arms 311 are moved by the actuator. To accommodate for the up-and-down motion of the poles 322 of the carousel horse and pole assemblies 302, the cover portion 308 is provided with a groove or slot 320.

To further enhance the carousel atmosphere, the carousel theme apparatus 300 may also be provided with a music box that is operatively associated with the actuator. During operation of the actuator, the music box plays appropriate carousel-type music.

Figure 19:
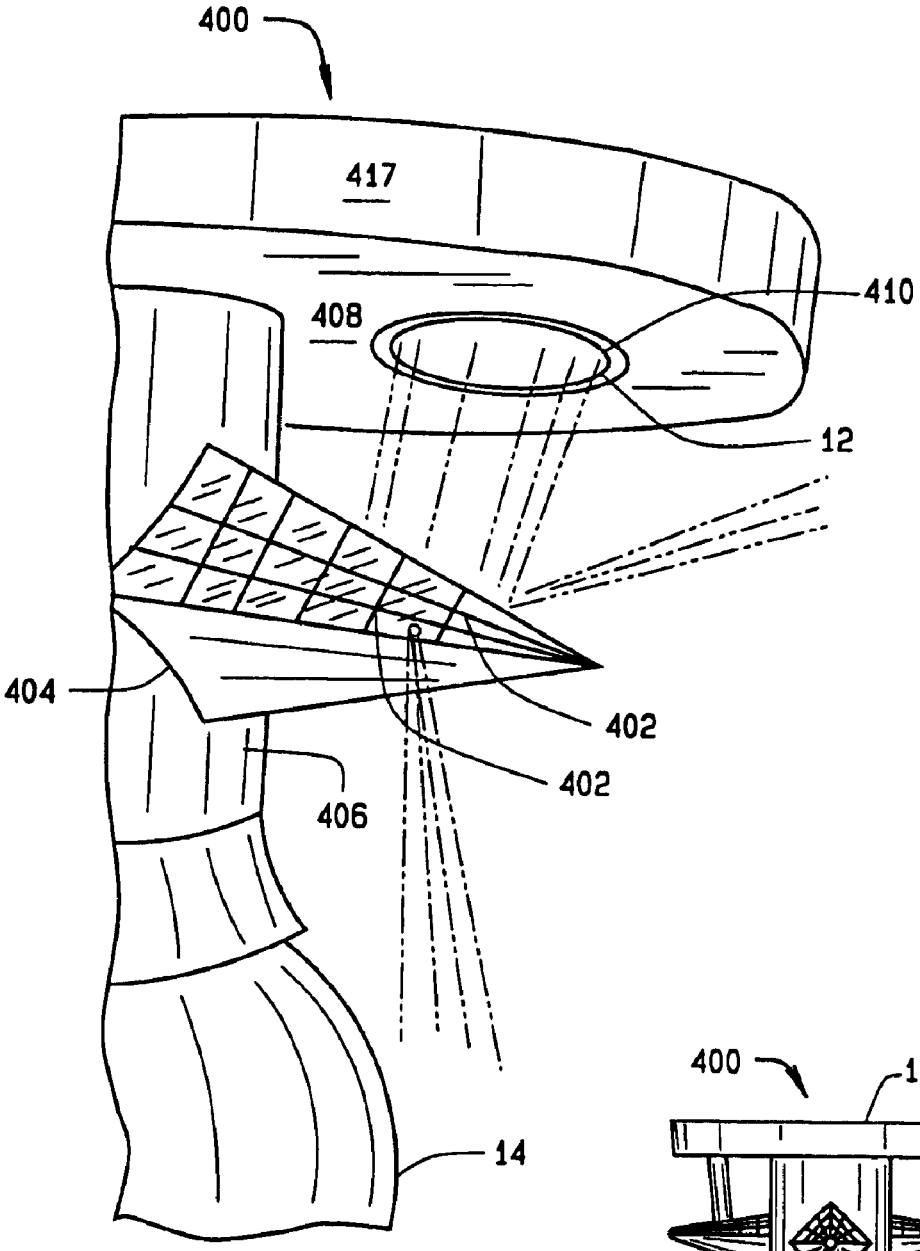
FIG. 19 is a partial perspective view of the theme-based illuminating mobile while provided with an exemplary disco theme apparatus.
Figure 20:
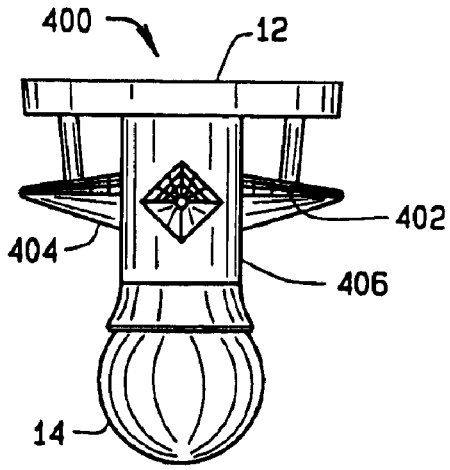
FIG. 20 is a side view of the theme-based illuminating mobile and disco theme apparatus shown in FIG. 19.

FIGS. 19 and 20 show another embodiment of the theme apparatus, i.e., a disco theme apparatus 400. The disco theme apparatus 400 comprises a hub 406 that is sized to be received over the second housing member 34. The hub 406 is rotated by the actuator when operating.

In the disco theme apparatus 400, the thematic components 404 include mirrors 402. The thematic components 404 are attached to the hub 406 such that the thematic components 404 and the mirrors 402 thereon rotate along with the hub 406. The thematic components 404 may be substantially triangularly shaped such that the disco theme apparatus 400 resembles a star when viewed from below. The mirrors 402 may be angled differently to reflect light in a disco-ball type fashion.

To ensure that at least a portion of the light from the first lighting device 12 is reflected by the mirrors 402, the disco theme apparatus 400 further includes a light-directing member 408 that defines at least one opening 410 therein. The light-directing member 408 is sized to substantially cover the shoulder 33 of the nightlight shade 30 such that light from the first lighting device 12 passes through the at least one opening 410 but not through the shoulder 33.

The disco theme apparatus 400 further includes a light-blocking member 417. The light-blocking member 417 is sized for placement circumferentially around and within grooves defined by the sidewall 70 of the nightlight shade 30. Accordingly, the light-blocking member 417 at least partially prevents light from traveling or passing outward through the sidewall 70 of the nightlight shade 30.

Figure 23:
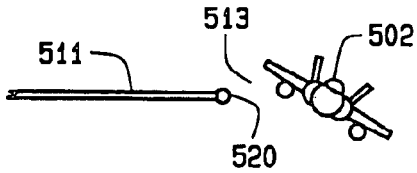
FIG. 23 is an exploded side view of an exemplary breakaway connection used to engage a mounting arm with a jet aircraft of the aerospace theme shown in FIGS. 21 and 22.
Figure 22:
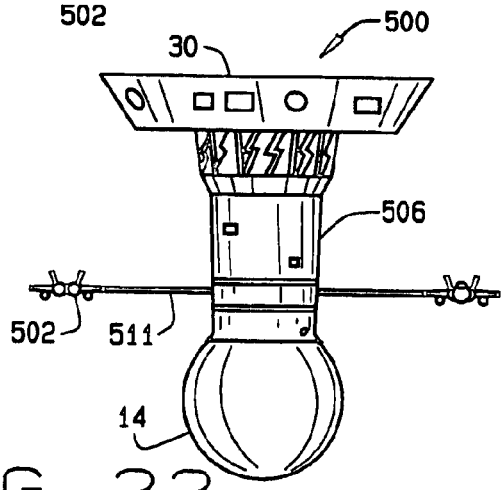
FIG. 22 is a side view of the theme-based illuminating mobile and aerospace theme apparatus shown in FIG. 21.

FIGS. 21 through 23 show an aerospace theme apparatus 500 in which the movable thematic components 502 comprise jet aircraft. Each jet aircraft is mounted by way of a breakaway connection 513 onto an end 520 of a mounting arm 511. The other end of the mounting arm 511 is operatively associated with the actuator such that the jet aircraft 502 attached thereto rotates about the hub 506 when the actuator is operating. As before with the carousel theme apparatus 300, the hub 506 may also define a track in which the mounting arm 511 is positioned. The track guides the mounting arm 511 in a manner to impart translation or up-and-down motion to the jet aircraft 502 as it rotates about the hub 506.

The hub 506 is sized to be received over the second housing member 34 and is preferably decorated to resemble an air traffic control tower. The hub 506 also includes one or more holes 531 therein that allow light from the lighting devices 12 and/or 14 to pass therethrough. Colored film may be disposed adjacent the holes 531 to change the color of the light passing therethrough before it becomes visible to the user. Moreover, a light-blocking member may be positioned within the hub 506 that is movable by the actuator to intermittently cover one or more of the holes 531, thus providing the appearance of a blinking light.

In addition, the aerospace theme apparatus 500 further includes an aerospace pattern filter 508 sized to be received within grooves defined by the sidewall 70 of the nightlight shade 30. Accordingly, light emitted by the first lighting device 12 and passing through the nightlight shade 30 is filtered by the aerospace pattern filter 508. As shown, the aerospace pattern filter 508 is provided with aircraft schematics 532, although other suitable patterns may also be used.

FIGS. 24 through 31 illustrate another embodiment of the theme-based illuminating mobile 610 that includes a first and a second light source 612 and 614. The light sources 612 and 614 allow the theme-based illuminating mobile 610 to provide night light and regular light. Light from either or both of the lighting devices 612 and/or 614 may also be altered (e.g., refracted, reflected, diffracted, dispersed, etc.) to produce light patterns and effects in accordance with the theme of the mobile 610.

Figure 24:
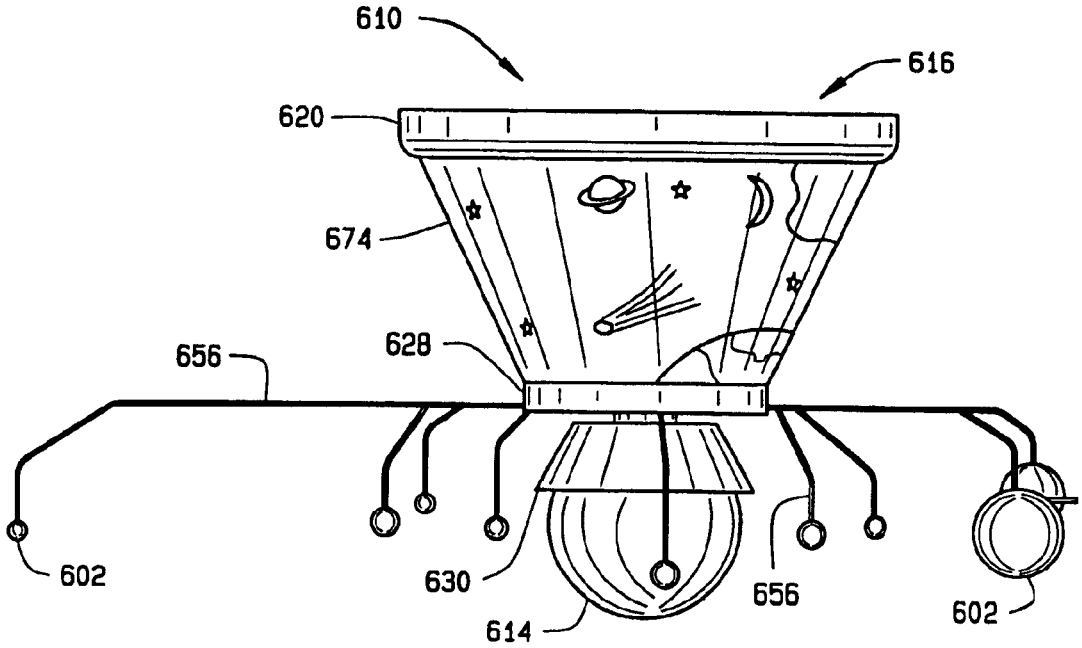
FIG. 24 is a side view of another exemplary embodiment of the theme-based illuminating mobile while provided with an exemplary celestial theme apparatus.

As before with the first embodiment 10, the theme-based illuminating mobile 610 also includes a plurality of readily interchangeable theme apparatus, such as the outer space theme apparatus 616 shown in FIG. 24. Each theme apparatus includes at least one movable thematic component 602 (e.g., a planetary body) that is movable by an actuator.

Figure 26:
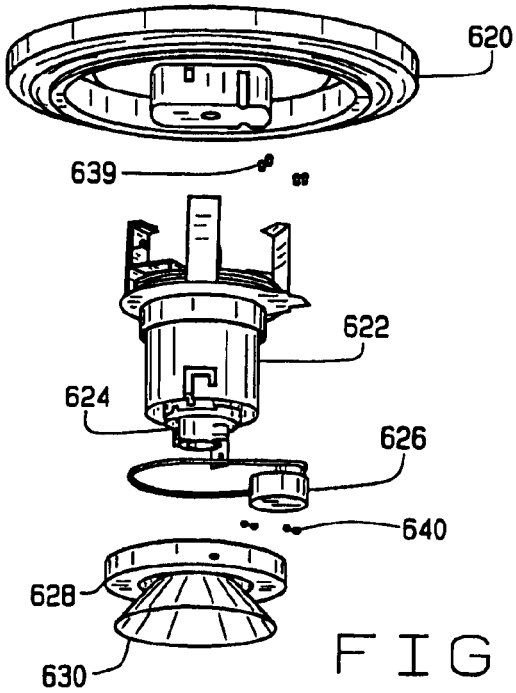
FIG. 26 is an exploded perspective view of the mounting apparatus shown in FIG. 25.

FIG. 26 illustrates the mounting apparatus 618 of the theme-based illuminating mobile 610. The mounting apparatus 618 includes a base 620, a housing 622, a socket apparatus 624 (FIG. 29), a motor 626 (FIG. 30), an arm base 628 (FIG. 27), and a chain guide 630. The base 620 is configured to allow the theme-based illuminating mobile 610 to be installed into an existing ceiling junction box.

Figure 28:
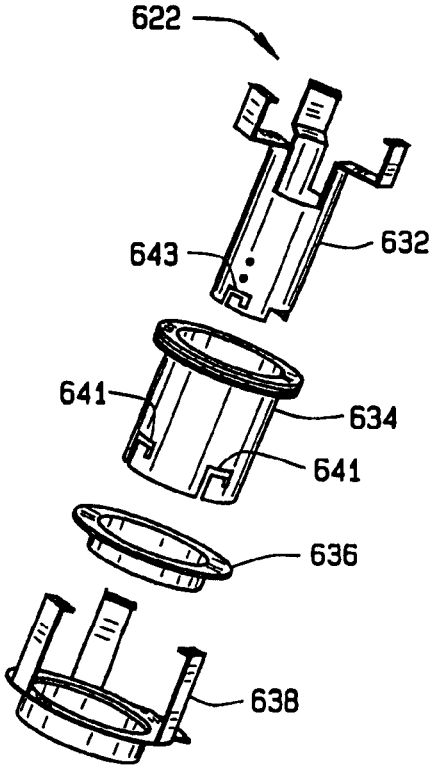
FIG. 28 is an exploded perspective view of the exemplary housing shown in FIG. 26.

Referring now to FIG. 28, the housing 622 includes a first housing member 632 engageable with the base 620, a second housing member 634 rotatable by the actuator, a bearing 636, and a third housing member 638 engageable with the first housing member 632. Any one of a wide range of suitable fastening systems and devices may be used to engage the first housing member 632 with the base 620 and to engage the third housing member 638 to the first housing member 632. By way of example only, screws 639 and nuts 640 having internal tooth washers may be used (FIG. 26).

Figure 27:
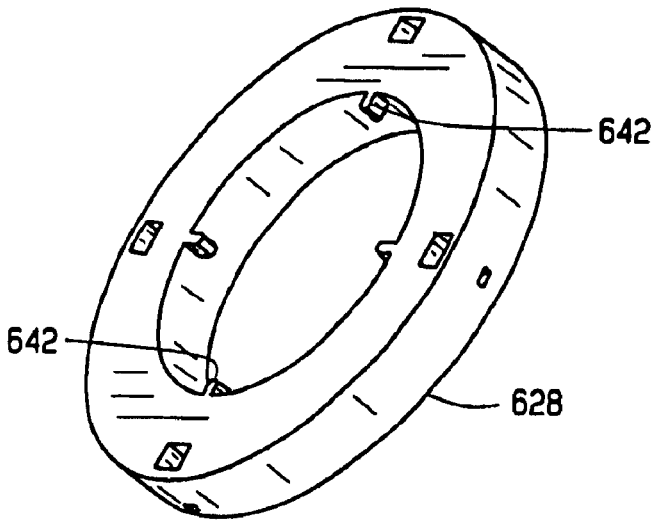
FIG. 27 is a detailed perspective view of the exemplary arm base shown in FIG. 26.

To allow the second housing member 634 and the arm base 628 to be readily engaged and disengaged, the second housing member 634 defines a plurality of bayonets 641 (FIG. 28). As shown in FIG. 27, the arm base 628 includes a corresponding number of locking members 642 sized to be received in the bayonets 641.

Similarly, the first housing member 632 also includes a plurality of bayonets 643 as shown in FIG. 28. The chain guide 630 includes a corresponding number of locking members 644 (FIG. 31) sized to be received in the bayonets 643 of the first housing member 632. Accordingly, the first housing member 632 and chain guide 630 may be readily engaged and disengaged by way of the engagement and disengagement of the bayonets 643 and locking members 644.

Figure 30:
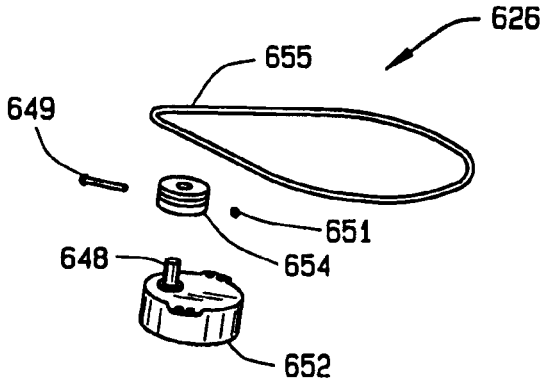
FIG. 30 is an exploded perspective view of the exemplary motor shown in FIG. 26.
Figure 31:
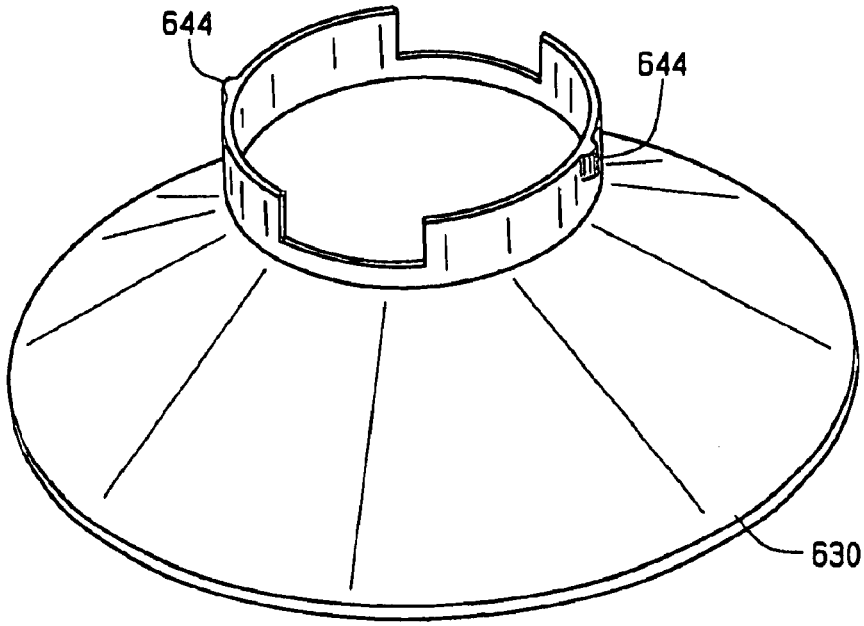
FIG. 31 is a detailed perspective view of the chain guide shown in FIG. 24.

As shown in FIG. 30, the actuator comprises the motor assembly 626 which includes a motor 652 having a shaft 648. A pulley 654 is mounted to the motor shaft 648 with a mechanical fastener, such as a screw 649 and a nut 651 having an internal tooth washer. The actuator further includes an o-ring belt 655 engaged with the pulley 654 and the second housing member 634, as shown in FIG. 25.

When the theme-based illuminating mobile 610 is fully assembled, the actuator operates as follows: the motor 652 rotates the motor shaft 648; the rotating motor shaft 648 rotates the pulley 654; the rotating pulley 654 rotates the second housing member 634; the rotating housing member 634 rotates the arm base 628; and the rotating arm base 628 rotates the mounting arms 656 and the movable thematic components 602 attached thereto.

Figure 25:
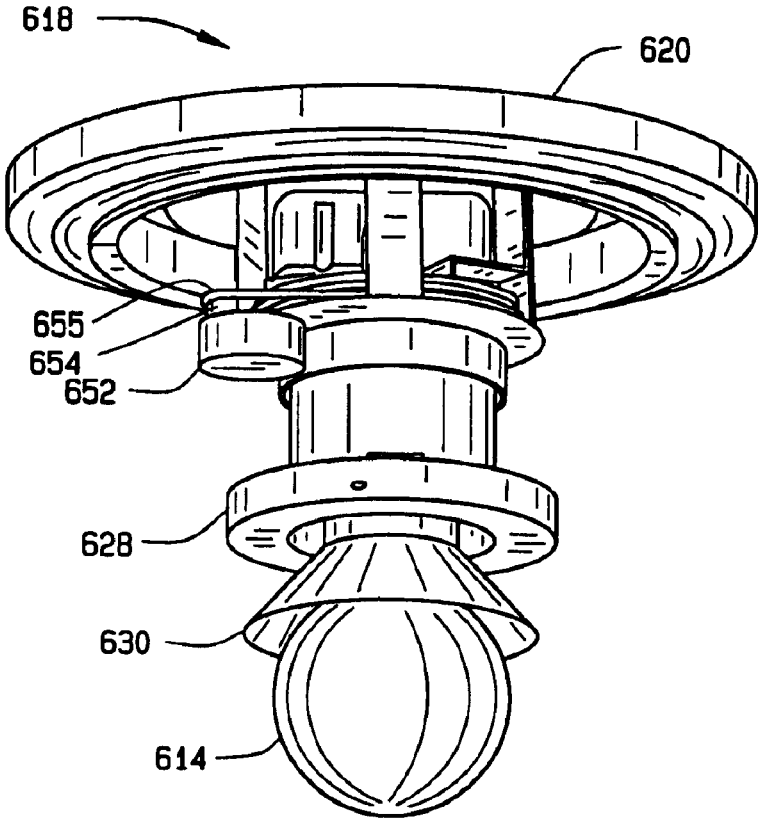
FIG. 25 is a perspective view of an exemplary mounting apparatus of the theme-based illuminating mobile shown in FIG. 24.

As shown in FIG. 25, the second lighting device 614 is positioned substantially distally and centrally with respect to the theme-based illuminating mobile 610. The second lighting device 614 is mounted to the theme-based illuminating mobile 610 by way of the socket apparatus 624 (FIG. 29).

Figure 29:
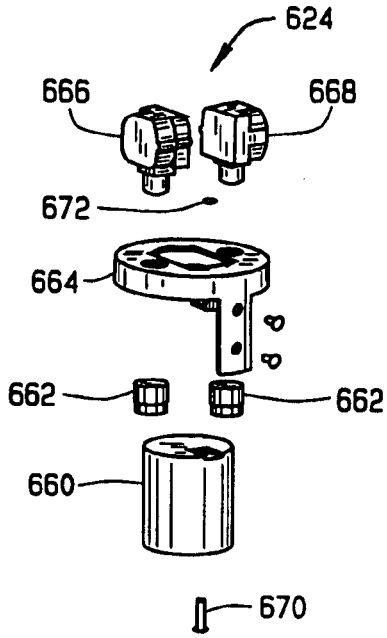
FIG. 29 is an exploded perspective view of an exemplary socket apparatus of the theme-based illuminating mobile shown in FIG. 26.

In the embodiment shown in FIG. 29, the socket apparatus 624 includes a socket 660, chain switch nuts 662, a socket fixture 664, a two way chain switch 666, and a three way chain switch 668. The second lighting device 614 is threadably mounted to the socket 660, which in turn is mounted to the socket fixture 664 via a mechanical fastener, such as a screw 670 and a corresponding nut 672.

Figure 32:
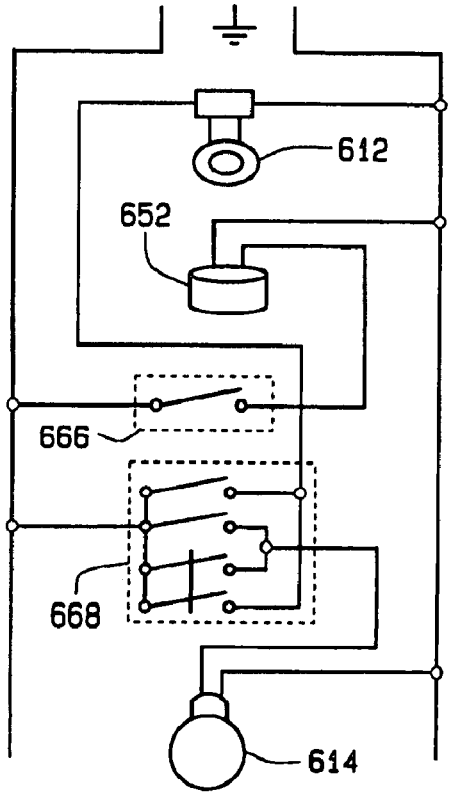
FIG. 32 is an exemplary wiring schematic that may be used for the theme-based illuminating mobile shown in FIG. 24.

The chain switches 666 and 668 and the wall-mounted switch for the ceiling junction box allow a user to select from amongst the various operating modes for the theme-based illuminating mobile 610. The wall-mounted light switch controls the flow of electricity to the theme-based illuminating mobile 10. The two way chain switch 666 selects the operational status (i.e., on/off) of the motor 652, whereas the three way chain switch 668 toggles between the first and second lighting devices 612 and 614, as shown in FIG. 32.

The celestial theme apparatus 616 will now be described in greater detail. As shown in FIG. 24, the celestial theme apparatus 616 includes a celestial nightlight lens 674 sized to be disposed between the arm base 628 and the base 620. When assembled, the nightlight lens 674 is disposed substantially around the first lighting device 612 and filters light emitted from the first lighting device 612. The nightlight lens 674 is configured such that the light filtered thereby displays a celestial pattern. For example, the filtered light may display a silhouette or image of a celestial body, such as a star, comet, planet, moon, black hole, rocket, space ship, satellite, among others.

As previously described, the celestial theme apparatus 616 includes a plurality of planetary bodies 602 that are attached to the mounting arms 656. The mounting arms 656 are attached to the arm base 628, which is rotatable by the actuator.

To enhance the realism, educational value, and thematic atmosphere, among other things, the theme-based illuminating mobile in another embodiment is configured such that one or more of the planets orbits the second lighting device at a different speed than that of the other planets. To allow for the different orbital speeds, the theme-based illuminating mobile includes a plurality of arm bases. Each arm base is rotated by the motor by way of a separate pulley and o-ring belt, which have different sizes than that of the other pulleys and o-ring belts for the other arm bases.

The theme-based illuminating mobile 610 may be used as follows to provide a room with an outer space or celestial atmosphere. First, the electrical power to the apparatus 610 is shut off by way of the first switch. Next, the second lighting device 614 is removed from the socket 660. The chain guide 630 and arm base 628 are then removed by disengaging the locking members 642, 644 from the corresponding bayonets 641, 643.

The nightlight lens 674 is slid onto the apparatus 610 and then sandwiched between the base 620 and the arm base 628, which in turn is secured by engaging its locking members 642 with the bayonets 641 of the second housing member 634. The chain guide 630 is secured by engaging its locking members 644 with the bayonets 643 of the first housing member 632. Finally, the second lighting device 614 is threadably engaged to the socket 660.

Now that the theme-based illuminating mobile 610 has been provided with the celestial theme apparatus 616, the theme display mode may now be selected by accessing the first switch to activate the electrical power, the second switch 666 to select the operational status for the motor 652, and the third switch 668 to toggle between lighting devices 612 and/or 614.

Accordingly, the present invention provides a theme-based illuminating mobile 10 that is capable of providing a room with a thematic atmosphere as well as with night light or regular light. Because the present invention provides theme apparatus that may be readily removed from and/or added to the theme-based illuminating mobile 10, the present invention allows a user to readily change the thematic atmosphere of a room without the need for tools. The theme-based illuminating mobile 10 can also be readily retrofit to existing ceiling junction boxes with little to no additional tooling being needed and without the need for additional ceiling structural reinforcement.

The description of the invention is merely exemplary in nature and, thus, variations that do not depart from the substance of the invention are intended to be within the scope of the invention. Such variations are not to be regarded as a departure from the spirit and scope of the invention.

What is claimed is:

1. An apparatus for illuminating and decorating a room, the apparatus comprising:

a mounting apparatus including a first fixture adapted to receive a first light source and a second fixture adapted to receive a second light source for illuminating at least a portion of the room with regular light;

a theme apparatus engaged with the mounting apparatus, the theme apparatus including:

at least one thematic component movable relative to the mounting apparatus; and at least one light-altering component positioned relative to the mounting apparatus for receiving and altering light from the first light source when the first light source is engaged with the first fixture such that the altered light illuminates at least a portion of the room with thematic light.

2. The apparatus of claim 1, further comprising a plurality of theme apparatus each of which is engageable with the mounting apparatus.

3. The apparatus of claim 1, further comprising a motor coupled to the theme apparatus for rotating the thematic component relative to the mounting apparatus.

4. The apparatus of claim 1, further comprising a motor coupled to the theme apparatus for rotating the light-altering component relative to the mounting apparatus.

5. The apparatus of claim 1, further comprising means for coupling the theme apparatus to the mounting apparatus.

6. The apparatus of claim 1, wherein the light-altering component alters the light by at least one of refracting, reflecting, diffracting, and dispersing.

7. The apparatus of claim 1, wherein the thematic component comprises a light-altering component.

8. The apparatus of further of claim 1, further comprising at least one switch for selecting from amongst a plurality of operating modes for the apparatus.

9. The apparatus of claim 8, wherein the plurality of operating modes comprise:

an off mode;

a theme display mode; and a regular light mode.

10. The apparatus of claim 9, wherein the plurality of operating modes further comprises a nightlight mode.

11. The apparatus of claim 1, wherein the mounting apparatus is adapted to be installed into a ceiling junction box.

12. The apparatus of claim 1, wherein the theme apparatus comprises:

a base rotatable relative to the mounting apparatus; and an arm including a proximal end mounted to the base and a distal end on which is mounted the thematic component.

13. The apparatus of claim 1, wherein the theme apparatus comprises a celestial theme apparatus.

14. An apparatus for illuminating and decorating a room, the apparatus comprising:

a mounting apparatus including at least a first fixture adapted to receive at least a first light source and a bayonet;

a theme apparatus engaged with the mounting apparatus, the theme apparatus including:

at least one thematic component movable relative to the mounting apparatus;

at least one light-altering component positioned relative to the mounting apparatus for receiving and altering light from the first light source when the first light source is engaged with the first fixture such that the altered light illuminates at least a portion of the room with thematic light; and a locking member sized to be received within the bayonet.

15. The apparatus of claim 14, further comprising a plurality of theme apparatus each of which is engageable with the mounting apparatus.

16. The apparatus of claim 14, further comprising a motor for rotating at least one of the thematic component and the light-altering component relative to the mounting apparatus.

17. The apparatus of claim 14, further comprising at least one switch for selecting from amongst a plurality of operating modes for the apparatus, the plurality of operating modes including a nightlight mode.

18. An apparatus for illuminating and decorating a room, the apparatus comprising:

a mounting apparatus including at least a first fixture adapted to receive at least a first light source;

at least one switch for selecting from amongst a plurality of operating modes for the apparatus, the plurality of operating modes comprising an off mode, a theme display mode, a regular light mode, and a nightlight model;

a theme apparatus engaged with the mounting apparatus, the theme apparatus including:

at least one thematic component movable relative to the mounting apparatus; and at least one light-altering component positioned relative to the mounting apparatus for receiving and altering light from the first light source when the first light source is engaged with the first fixture such that the altered light illuminates at least a portion of the room with thematic light.

19. The apparatus of claim 18, further comprising a plurality of theme apparatus each of which is engageable with the mounting apparatus.

20. The apparatus of claim 18, further comprising a motor for rotating at least one of the thematic component and the light-altering component relative to the mounting apparatus.

21. An apparatus for illuminating and decorating a room, the apparatus comprising:

a mounting apparatus including at least a first fixture adapted to receive at least a first light source;

a theme apparatus engaged with the mounting apparatus, the theme apparatus including:

at least one thematic component movable relative to the mounting apparatus;

at least one light-altering component positioned relative to the mounting apparatus for receiving and altering light from the first light source when the first light source is engaged with the first fixture such that the altered light illuminates at least a portion of the room with thematic light; and wherein the theme apparatus is configured to impart an up-and-down motion to the thematic component while the thematic component is rotating about the mounting apparatus.

22. The apparatus of claim 21, further comprising a plurality of theme apparatus each of which is engageable with the mounting apparatus.

23. The apparatus of claim 21, further comprising a motor for rotating at least one of the thematic component and the light-altering component relative to the mounting apparatus.

24. The apparatus of claim 21, further comprising at least one switch for selecting from amongst a plurality of operating modes for the apparatus, the plurality of operating modes including a nightlight mode.

25. An apparatus for illuminating and decorating a room, the apparatus comprising:

a mounting apparatus including:

a first light fixture adapted to receive a first light source for illuminating at least a portion of the room with thematic light;

a second light fixture adapted to receive a second light source for illuminating at least a portion of the room with regular light;

a theme apparatus engaged with the mounting apparatus, the theme apparatus including at least one thematic component movable relative to the mounting apparatus; and a motor coupled to the theme apparatus for rotating the thematic component relative to the mounting apparatus.

26. The apparatus of claim 25, wherein the theme apparatus comprises at least one light-altering component positioned relative to the mounting apparatus for receiving and altering light from the first light source when the first light source is engaged with the first fixture such that the altered light illuminates at least a portion of the room with thematic light.

27. The apparatus of claim 25, further comprising a plurality of theme apparatus each of which is engageable with the mounting apparatus.

28. The apparatus of claim 25, wherein the mounting apparatus is adapted to be installed into a ceiling junction box.

29. The apparatus of claim 25, further comprising at least one switch for selecting from amongst a plurality of operating modes for the apparatus, the plurality of operating modes including a nightlight mode.

30. The apparatus of claim 25, wherein:

the mounting apparatus includes a bayonet; and the theme apparatus includes a locking member sized to be received within the bayonet.

* * * * *